US007172393B2

(12) United States Patent
Adams et al.

(10) Patent No.: US 7,172,393 B2
(45) Date of Patent: Feb. 6, 2007

(54) MULTI-CYLINDER COMPRESSORS AND METHODS FOR DESIGNING SUCH COMPRESSORS

(75) Inventors: Douglas E. Adams, West Lafayette, IN (US); Yoshinobu Ichikawa, Gunma ken (JP); Jeongil Park, West Lafayette, IN (US); Werner Soedel, West Lafayette, IN (US)

(73) Assignee: Sanden Corporation, Gunma (JP)

( * ) Notice: Subject to any disclaimer, the term of this patent is extended or adjusted under 35 U.S.C. 154(b) by 462 days.

(21) Appl. No.: 10/464,515

(22) Filed: Jun. 19, 2003

(65) Prior Publication Data

US 2004/0047739 A1 Mar. 11, 2004

Related U.S. Application Data

(60) Provisional application No. 60/407,978, filed on Sep. 5, 2002.

(51) Int. Cl.
*F04B 1/26* (2006.01)
*F04B 43/12* (2006.01)
*F01B 3/00* (2006.01)

(52) U.S. Cl. ..... 417/222.1; 417/53; 417/222.2; 417/269; 92/71

(58) Field of Classification Search ..... 417/53, 417/222.1, 222.2, 269; 92/71
See application file for complete search history.

(56) References Cited

U.S. PATENT DOCUMENTS 5,228,841 A * 7/1993 Kimura et al. ..... 417/222.2
5,299,918 A * 4/1994 Teruo ..... 417/269
5,816,783 A * 10/1998 Oshima et al. ..... 417/415
6,227,811 B1 * 5/2001 Ahn ..... 417/222.1
2003/0044292 A1 3/2003 Shiina
2003/0175129 A1 9/2003 Iizuka et al.

* cited by examiner

*Primary Examiner*—Anthony D. Stashick
*Assistant Examiner*—Ryan P. Gillan
(74) *Attorney, Agent, or Firm*—Baker Botts L.L.P.

(57) ABSTRACT

A multi-cylinder compressor includes a valve plate having a plurality of cylinder suction ports formed therethrough, and a plurality of cylinder bores centered on an arc having a radius (R). The cylinder bores are substantially equally spaced from each other, and have a diameter (D). The compressor also includes a suction chamber having a substantially annular shape and adapted to be in fluid communication with each of the cylinder bores via the suction ports. Moreover, a center of a first of the suction ports is radially offset in a predetermined direction from a center of a predetermined suction port by a first angle, in which the predetermined suction port has a diameter (d), and the first angle equals $\{[(360°/N)\cdot([N-1]-n)]+X°\}$. In this formula, N is a number of the suction ports formed through the valve plate, n is a number of the suction ports positioned between the first suction port and the predetermined suction port in a direction opposite to the predetermined direction, and X° is a predetermined angle which is less than or equal to $\{(\sin^{-1}[(D-d)/2\cdot R])\cdot 57.3°/\text{Radian}\}$ and greater than or equal to $-\{(\sin^{-1}[(D-d)/2\cdot R]\cdot 57.3°/\text{Radian}\}$, and which is not equal to 0°.

87 Claims, 13 Drawing Sheets

Noise Generated by Compressor 100 Relative to When Suction Ports 900 are Equilangularly Spaced From Each Other Degrees Offset From Initial Position

| Suction Port 900 | | | | | | | Pulsation Ratio |
|---|---|---|---|---|---|---|---|
| 900a | 900b | 900c | 900d | 900e | 900f | 900g | N2/N1 |
| 10 | 0 | 0 | 0 | 0 | 0 | 0 | 1.0027 |
| −10 | 0 | 0 | 0 | 0 | 0 | 0 | 1.0023 |
| 0 | 10 | 0 | 0 | 0 | 0 | 0 | 1.0255 |
| 0 | −10 | 0 | 0 | 0 | 0 | 0 | 0.9729 |
| 0 | 0 | 10 | 0 | 0 | 0 | 0 | 0.9812 |
| 0 | 0 | −10 | 0 | 0 | 0 | 0 | 1.0092 |
| 0 | 0 | 0 | 10 | 0 | 0 | 0 | 0.9826 |
| 0 | 0 | 0 | −10 | 0 | 0 | 0 | 1.0201 |
| 0 | 0 | 0 | 0 | 10 | 0 | 0 | 1.0193 |
| 0 | 0 | 0 | 0 | −10 | 0 | 0 | 0.9829 |
| 0 | 0 | 0 | 0 | 0 | 10 | 0 | 1.0068 |
| 0 | 0 | 0 | 0 | 0 | −10 | 0 | 0.9857 |
| 0 | 0 | 0 | 0 | 0 | 0 | 10 | 0.9719 |
| 0 | 0 | 0 | 0 | 0 | 0 | −10 | 1.0214 |
| 10 | 10 | 0 | 0 | 0 | 0 | 0 | 1.0304 |
| −10 | −10 | 0 | 0 | 0 | 0 | 0 | 0.9781 |
| 0 | 10 | 10 | 0 | 0 | 0 | 0 | 1.0058 |
| 0 | −10 | −10 | 0 | 0 | 0 | 0 | 0.9817 |
| 0 | 0 | 10 | 10 | 0 | 0 | 0 | 0.9641 |
| 0 | 0 | −10 | −10 | 0 | 0 | 0 | 1.0297 |
| 0 | 0 | 0 | 10 | 10 | 0 | 0 | 1.0051 |
| 0 | 0 | 0 | −10 | −10 | 0 | 0 | 1.0063 |
| 0 | 0 | 0 | 0 | 10 | 10 | 0 | 1.0264 |
| 0 | 0 | 0 | 0 | −10 | −10 | 0 | 0.9688 |
| 0 | 0 | 0 | 0 | 0 | 10 | 10 | 0.9823 |
| 0 | 0 | 0 | 0 | 0 | −10 | −10 | 1.0064 |
| 0 | −10 | 0 | 0 | 0 | 0 | 10 | 0.9469 |
| 0 | −10 | 0 | 10 | −10 | 0 | 10 | 0.9091 |
| 0 | −10 | 10 | 10 | −10 | −10 | −10 | 0.8752 |

FIG. 7

RMS Average Pressure Pulsation Relative to When Di=12 mm and r=50 mm

| Di \ r | 46 mm | 48 mm | 50 mm | 52 mm | 54 mm |
|---|---|---|---|---|---|
| 6 mm | 1.2456 | 0.9376 | 1.4041 | 8.6800 | 1.9039 |
| 8 mm | 1.2086 | 0.9281 | 1.3264 | 3.1804 | 1.7668 |
| 10 mm | 1.1150 | 0.9014 | 1.1708 | 1.7808 | 1.5005 |
| 12 mm | 0.9893 | 0.8546 | 1.0000 | 1.2412 | 1.2176 |
| 14 mm | 0.8657 | 0.7922 | 0.8581 | 0.9663 | 0.9876 |

FIG. 9

MULTI-CYLINDER COMPRESSORS AND METHODS FOR DESIGNING SUCH COMPRESSORS

This application claims the benefit of U.S. Provisional Patent Application No. 60/407,978, filed Sep. 5, 2002, which is incorporated herein by reference.

BACKGROUND OF THE INVENTION

1. Field of the Invention

The invention relates generally to multi-cylinder compressors for use in air conditioning systems for vehicles. More particularly, the invention relates to multi-cylinder compressors having a plurality of suction ports formed through a valve plate, in which the suction ports are spaced from each other so as to reduce noise or vibration, or both, generated by the compressor.

2. Description of Related Art

Referring to FIG. 1, a known, swash plate-type, multi-cylinder compressor 1 for use in an air conditioning system of a vehicle (not shown), is depicted. Compressor 1 includes a front housing 17, a cylinder block 16, a rear housing 18, and a drive shaft 10. Front housing 17, cylinder block 16, and rear housing 18 is fixably attached to each other by a plurality of bolts 15. Drive shaft 10 passes through the center of front housing 17 and the center of cylinder block 16. Drive shaft 10 also is rotatably supported by front housing 17 and by cylinder block 16 via a pair of bearings 11 and 12 mounted in front housing 17 and cylinder block 16, respectively. A plurality of cylinder bores 16*a* is formed within cylinder block 16, and cylinder bores 16*a* also are positioned equiangularly around an axis of rotation 20 of drive shaft 10. Moreover, a piston 25 is slidably disposed within each cylinder bore 16*a*, such that pistons 25 reciprocate on axes parallel to axis 20 of drive shaft 10.

Compressor 1 also includes a rotor 21, a crank chamber 30, and a swash plate 13. Specifically, rotor 21 is fixed to drive shaft 10, such that drive shaft 10 and rotor 21 rotate together. Crank chamber 30 is formed between front housing 17 and cylinder block 16, and swash plate 13 is positioned inside crank chamber 30. Swash plate 13 is slidably connected to each piston 25 via a pair of shoes 14 positioned between swash plate 13 and each of pistons 25. Swash plate 13 includes a penetration hole 13*c* formed therethrough at a center portion of swash plate 13, and drive shaft 10 extends through penetration hole 13*c*. Rotor 21 includes a pair of rotor arms 21*a*, and a pair of oblong holes 21*b* formed through rotor arms 21*a*, respectively. Swash plate 13 further includes a pair of swash plate arms 13*a*, and a pair of pins 13*b* extend from swash plate arms 13*a*, respectively. A hinge mechanism 19 includes rotor arms 21*a*, swash plate arms 13*a*, oblong holes 21*b*, and pins 13*b*, and rotor 21 is connected to swash plate 13 by hinge mechanism 19. Specifically, one of pins 13*b* is inserted into and slidably engages an inner wall of one of oblong holes 21*b*, and another of pins 13*b* is inserted into and slidably engages an inner wall of another of oblong holes 21*b*. Moreover, because each of pins 13*b* is slidably disposed within their corresponding oblong hole 21*b*, the tilt angle of swash plate 13 may be varied with respect to drive shaft 10, such that the fluid displacement of compressor 1 also may be varied.

Compressor 1 further includes a valve plate 40 having a vertical center axis 110 which is perpendicular to axis 20 of drive shaft 10, a discharge chamber 70, a suction chamber 80, and a suction gas inlet passage 60. Suction chamber 80 extends around discharge chamber 70. Moreover, valve plate

40 has a plurality of cylinder suction ports 90 and a plurality of discharge ports 101 formed therethrough. Specifically, referring to FIG. 2, each of suction ports 90 has a center portion 95, and center portions 95 are equiangularly spaced along an arc having a radius (R), i.e., angles $\theta_a - \theta_g$, formed between adjacent suction ports 90 are equal to 360°/N, in which N is the number of suction ports 90 formed through valve plate 40. For example, referring again to FIG. 1, when compressor 1 is a three-cylinder compressor, an angle of 120° (360°/3) is formed between adjacent suction ports 90, and when compressor 1 is a five-cylinder compressor, an angle of 72° (360°/5) is formed between adjacent suction ports 90. Similarly, when compressor 1 is a seven-cylinder compressor, an angle of about 51.4° (360°/7) is formed between adjacent suction ports 90.

Compressor 1 also may include an electromagnetic clutch (not shown). When the electromagnetic clutch is activated, a driving force from an external driving source (not shown) is transmitted to drive shaft 10, such that drive shaft 10, rotor 21, and swash plate 13 rotate about axis 20 of drive shaft 10. Moreover, swash plate 13 also moves back and forth in a wobbling motion, such that only movement in a direction parallel to axis 20 of drive shaft 10 is transferred from swash plate 13 to pistons 25. Consequently, each piston 25 reciprocates within its corresponding cylinder bore 16*a*. In operation, a fluid, e.g., a refrigerant, is introduced into suction chamber 80 via suction gas inlet passage 60. During a suction stroke of piston 25, the fluid flows through the corresponding suction port 90 into a corresponding compression chamber 50 which is formed by a top portion of a corresponding piston 25, the walls of a corresponding cylinder bore 16*a*, and valve plate 40. The fluid subsequently is compressed by piston 25 during a compression stroke, and the compressed fluid flows into discharge chamber 70 via discharge ports 101.

Nevertheless, during the operation of compressor 1, dynamic pressure pulsations in suction chamber 80 are generated by the reciprocating motion of pistons 25, and the dynamic pressure pulsations pass to compression chamber 50 during the suction stroke of pistons 25. Such dynamic pressure pulsations reduce a performance of compressor 1, and also increase noise or vibration, or both, within compressor 1. The dynamic pressure pulsations also may affect a timing of an opening or a closing, or both, of a suction valve (not numbered). In attempting to decrease this noise, vibration, or both, a method of designing such known, multi-cylinder compressors includes the steps of kinematically determining a mass flow rate within suction chamber 80, i.e., a mass of a fluid delivered to suction chamber 80 per unit of time. Moreover, based on known relationships for determining dynamic pressure pulsations in suction chamber 80, the method also includes the steps of increasing a depth 120 of suction chamber 80, and increasing a width 130 of suction chamber 80, in which a cross-sectional area of suction chamber 80 equals depth 120·width 130. Further, based on the known relationships, the method includes the step of increasing a mean radius of suction chamber 80, in which suction chamber 80 has a varying radius measured from a center of discharge chamber 70. Specifically, depth 120, width 130, and the mean radius of suction chamber 80 are inverse factors of the known relationship. Consequently, when the kinematic mass flow rate is factored into the relationship, increasing any of depth 120, width 130, and the mean radius of suction chamber 80 theoretically decreases the dynamic pressure pulsations within suction chamber 80.

SUMMARY OF THE INVENTION

Therefore, a need has arisen for multi-cylinder compressors which overcome these and other shortcomings of the related art. A technical advantage of the present invention is that the suction ports may be spaced from each other so as to reduce noise or vibrations, or both, generated by the compressor. Another technical advantage of the present invention is that the mean radius of the suction chamber and the diameter of the suction gas inlet passage may be selected so as to reduce noise or vibrations, or both, generated by the compressor. Specifically, the mean radius of the suction chamber and the diameter of the suction gas inlet passage may be selected such that each frequency component of a mass flow rate within the suction chamber is not within a predetermined range, e.g., 25 Hz, of at least one resonant frequency of the suction chamber.

In an embodiment of the present invention, a multi-cylinder compressor is described. The compressor comprises a valve plate having a plurality of cylinder suction ports formed therethrough, and a plurality of cylinder bores centered on an arc having a radius (R). The cylinder bores are substantially equally spaced from each other, and have a diameter (D). The compressor also comprises a suction chamber having a substantially annular shape and adapted to be in fluid communication with each of the cylinder bores via the suction ports. Moreover, a center of a first of the suction ports is radially offset in a predetermined direction from a center of a predetermined suction port by a first angle, in which the predetermined suction port has a diameter (d), and the first angle equals $\{[(360°/N)\cdot([N-1]-n)]+X°\}$. In this formula, N is a number of the suction ports formed through the valve plate, n is a number of the suction ports positioned between the first suction port and the predetermined suction port in a direction opposite to the predetermined direction, and X° is a predetermined angle which is less than or equal to $\{(\sin^{-1}[(D-d)/2\cdot R])\cdot 57.3°/\text{Radian}\}$ and greater than or equal to $-\{(\sin^{-1}[(D-d)/2\cdot R]\cdot 57.3°/\text{Radian}\}$, and which is not equal to 0°. Specifically, Radians may be converted into degrees using a conversion factor equal to (630/11)°/Radian, i.e., about 57.3°/Radian.

In another embodiment of the present invention, a suction manifold joining a plurality of cylinders in a suction chamber is described. The suction manifold comprises a plurality of cylinder bores centered on an arc having a radius (R). The cylinder bores are substantially equally spaced from each other, and have a diameter (D). The suction manifold also comprises a valve plate comprising a plurality of cylinder suction ports formed therethrough. Moreover, a center of a first of the suction ports is radially offset in a predetermined direction from a center of a predetermined suction port by a first angle, in which the predetermined suction port has a diameter (d), and the first angle equals $\{[(360°/N)\cdot([N-1]-n)]+X°\}$. In this formula, N is a number of the suction ports formed through the valve plate, n is a number of the suction ports positioned between the first suction port and the predetermined suction port in a direction opposite to the predetermined direction, and X° is a predetermined angle which is less than or equal to $\{(\sin^{-1}[(D-d)/2\cdot R]\cdot 57.3°/\text{Radian}\}$ and greater than or equal to $-\{(\sin^{-1}[(D-d)/2\cdot R]\ 57.3°/\text{Radian}\}$, and which is not equal to 0°.

In yet another embodiment of the present invention, a multi-cylinder compressor is described. The compressor comprises a valve plate having a plurality of cylinder suction ports formed therethrough, in which a first suction port is positioned adjacent to a second suction port, and the second suction port is positioned adjacent to a third suction port. The compressor also comprises a plurality of cylinder bores, and a suction chamber having a substantially annular shape and adapted to be in fluid communication with each of the cylinder bores via the suction ports. Moreover, the second suction port is radially offset from the first suction port by a first angle, and the third suction port is radially offset from the second suction port by a second angle, in which the first angle is greater than or less than, but not equal to, the second angle.

In still another embodiment of the present invention, a valve plate assembly is described. The valve plate assembly comprises a valve plate having a plurality of cylinder suction ports formed therethrough. A first suction port is positioned adjacent to a second suction port, and the second suction port is positioned adjacent to a third suction port. Moreover, the second suction port is radially offset from the first suction port by a first angle, and the third suction port is radially offset from the second suction port by a second angle, in which the first angle is greater than or less than the second angle.

In still yet another embodiment of the present invention, a method of designing a multi-cylinder compressor is described. The compressor comprises a valve plate having a plurality of cylinder suction ports formed therethrough, and a plurality of cylinder bores. The compressor also comprises a suction chamber having a substantially annular shape and adapted to be in fluid communication with each of the cylinder bores via the suction ports, in which the suction chamber has a varying radius. The compressor further comprises a suction gas inlet passage connected to the suction chamber. The method comprises the steps of selecting an operating speed for the compressor, selecting a depth for the suction chamber, selecting a width for the suction chamber, and selecting a first mean radius for the suction chamber. The method also comprises the steps of selecting a first diameter for the suction gas inlet passage, and determining a frequency response of a mass flow rate within the suction chamber. Moreover, the method comprises the step of determining a first dynamic pressure response within the suction chamber.

Other objects, features, and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

FIG. 7 is a chart depicting various theoretical noise ratios for exemplary embodiments of a compressor.

FIG. 9 is a table depicting theoretical root mean square average pressure pulsation ratios for various exemplary embodiments of a compressor.

DETAILED DESCRIPTION OF PREFERRED EMBODIMENTS

Preferred embodiments of the present invention and their advantages may be understood by referring to FIGS. 3–12*b*, like numerals being used for like corresponding parts in the various drawings.

Figure 3:
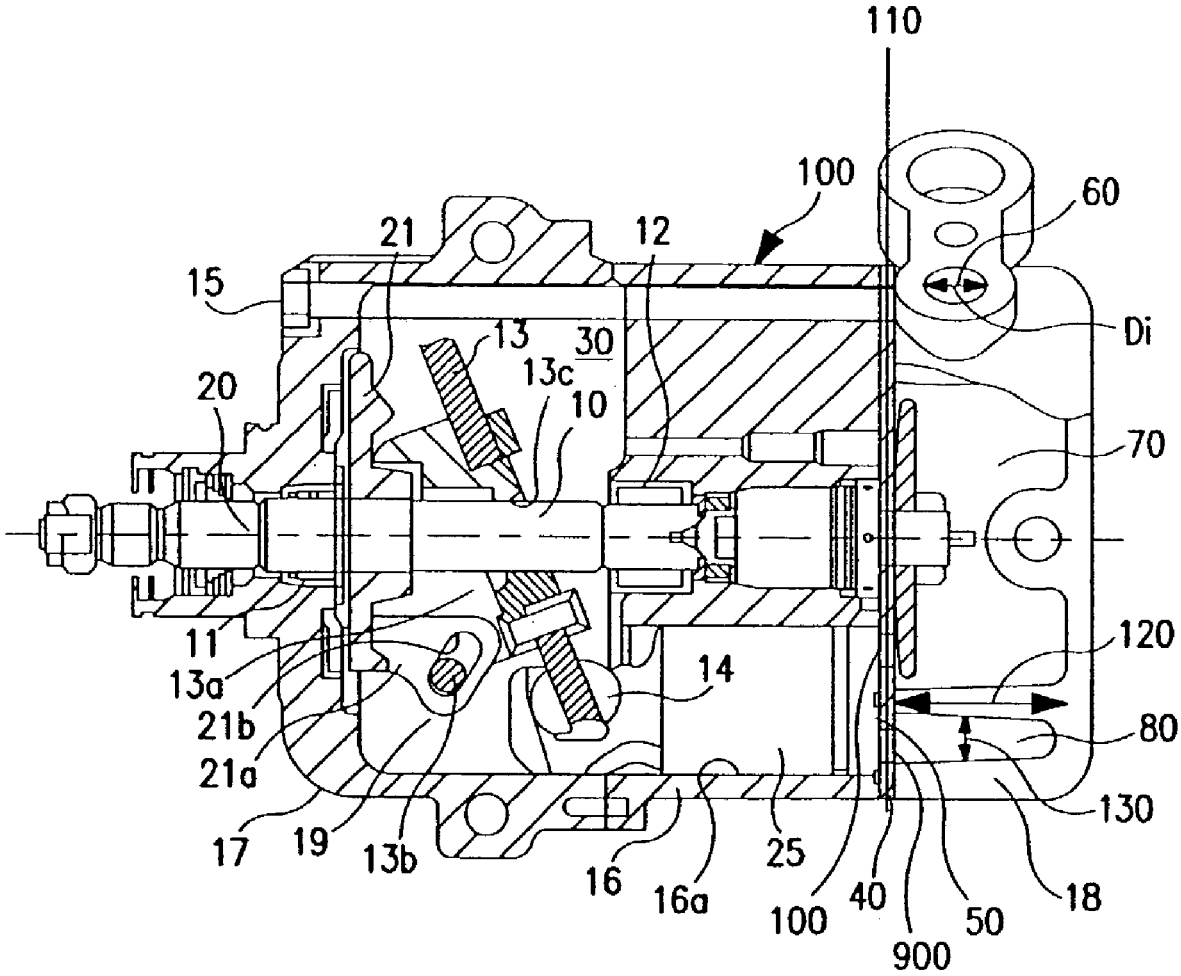
FIG. 3 is a cross-sectional view of a swash plate-type, multi-cylinder compressor according to an embodiment of the present invention.
Figure 5:
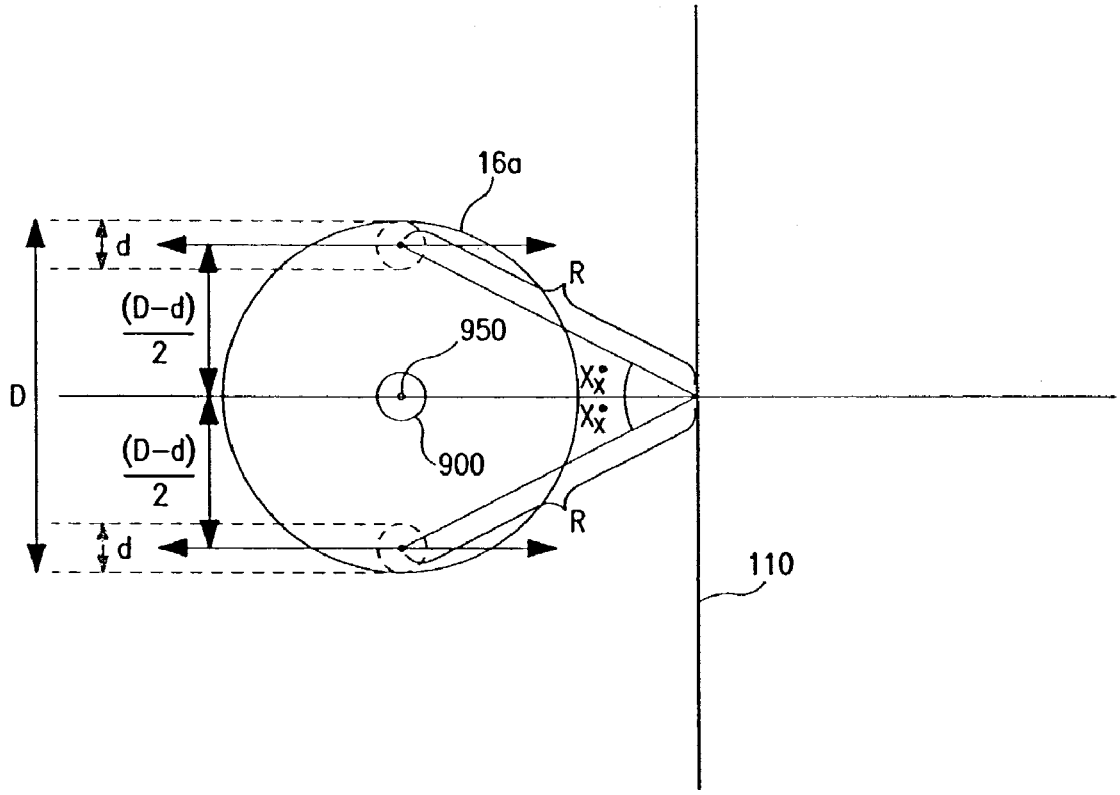
FIG. 5 is a schematic depicting a range of values for the predetermined angle X° of FIG. 4.

Referring to FIG. 3, a swash plate-type, multi-cylinder compressor 100 for use in an air conditioning system of a vehicle (not shown) according to an embodiment of the present invention is depicted. Although the present invention is described in connection with a swash plate-type compressor, it will be understood by those of ordinary skill in the art that the present invention may be employed in wobble plate-type compressors and other similar, multi-cylinder compressors. Compressor 100 includes a front housing 17, a cylinder block 16, a rear housing 18, and a drive shaft 10. Front housing 17, cylinder block 16, and rear housing 18 may be fixably attached to each other by a plurality of bolts 15. Drive shaft 10 may pass through the center of front housing 17 and the center of cylinder block 16. Drive shaft 10 also may be rotatably supported by front housing 17 and by cylinder block 16 via a pair of bearings 11 and 12 mounted in front housing 17 and cylinder block 16, respectively. A plurality of cylinder bores 16*a*, e.g., cylinder bores $\mathbf{16}a_1$–$\mathbf{16}a_7$ in a seven-cylinder compressor, may be formed within cylinder block 16, and cylinder bores 16*a* may be positioned substantially equiangularly around an axis of rotation 20 of drive shaft 10. As shown in FIG. 5, cylinder bores 16*a* may have a diameter (D). Moreover, a piston 25 may be slidably disposed within each of cylinder bores 16*a*, such that pistons 25 reciprocate on axes parallel to axis 20 of drive shaft 10.

Compressor 100 also includes a rotor 21, a crank chamber 30, and a swash plate 13. Specifically, rotor 21 is fixed to drive shaft 10, such that drive shaft 10 and rotor 21 rotate together. Crank chamber 30 is formed between front housing 17 and cylinder block 16, and swash plate 13 may be positioned inside crank chamber 30. Swash plate 13 may be slidably connected to each piston 25 via a pair of shoes 14 positioned between swash plate 13 and each of pistons 25. Swash plate 13 may include a penetration hole 13*c* formed therethrough at a center portion of swash plate 13, and drive shaft 10 may extend through penetration hole 13*c*. Rotor 21 includes a pair of rotor arms 21*a* and a pair of oblong holes 21*b* formed through rotor arms 21*a*, respectively. Swash plate 13 further may include a pair of swash plate arms 13*a* and at least one pin 13*b* extending from swash plate arms 13*a*. A hinge mechanism 19 includes rotor arms 21*a*, swash plate arms 13*a*, oblong holes 21*b*, and pin 13*b*, and rotor 21 may be connected to swash plate 13 by hinge mechanism 19. Moreover, the tilt angle of swash plate 13 may be varied with respect to drive shaft 10, such that the fluid displacement of compressor 100 also may be varied.

Compressor 100 further may include a valve plate 40 having a vertical center axis 110, a discharge chamber 70, a suction chamber 80, and a suction gas inlet passage 60. Suction chamber 80 may have a substantially annular shape, and may extend around discharge chamber 70. In an embodiment, suction chamber 80 may have a varying radius, and a mean radius (r) of suction chamber 80 may be between about 46 mm and about 54 mm. Further, suction gas inlet passage 60 may have a diameter (Di) between about 6 mm and about 14 mm. Moreover, valve plate 40 may have a plurality of cylinder suction ports 900, e.g., suction ports 900*a*–900*g* in a seven-cylinder compressor, and a plurality of discharge ports 101 formed therethrough. As shown in FIG. 5, suction ports 900 may have a diameter (d). Compressor 100 also may include an electromagnetic clutch (not shown). When the electromagnetic clutch is activated, a driving force from an external driving source (not shown) is transmitted to drive shaft 10, such that drive shaft 10, rotor 21, and swash plate 13 rotate about axis 20 of drive shaft 10. Moreover, swash plate 13 also moves back and forth in a wobbling motion, such that movement in a direction parallel to axis 20 of drive shaft 10 is transferred from swash plate 13 to pistons 25. Consequently, each piston 25 reciprocates within its corresponding cylinder bore 16*a*. In operation, a fluid, e.g., a refrigerant, is introduced into suction chamber 80 via suction gas inlet passage 60. During a suction stroke of piston 25, the fluid flows through the corresponding suction port 900 into a corresponding compression chamber 50 which is formed by a top portion of a corresponding piston 25, the walls of a corresponding cylinder bore 16*a*, and valve plate 40. The fluid subsequently is compressed by piston 25 during a compression stroke, and the compressed fluid flows into discharge chamber 70 via discharge ports 101.

Figure 4:
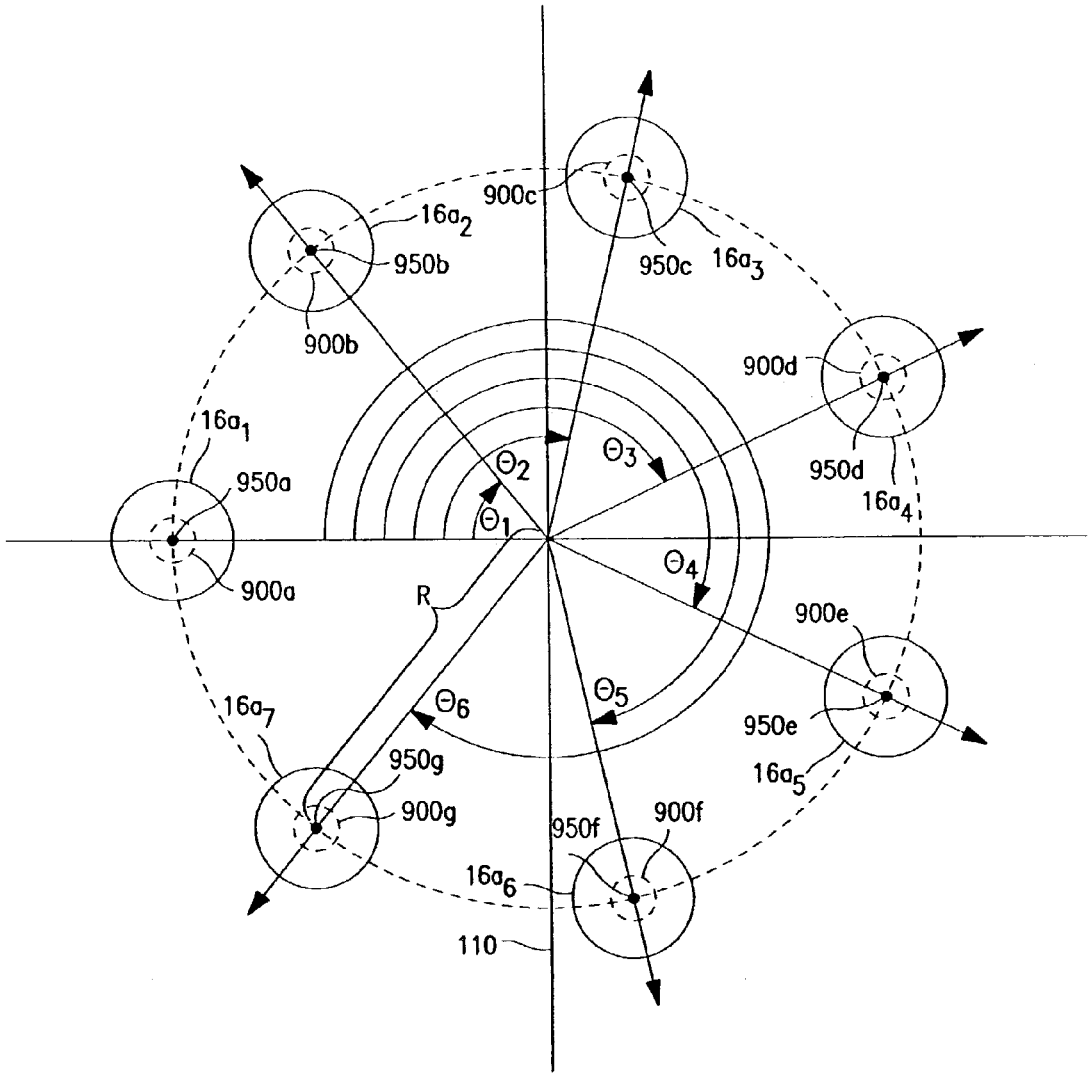
FIG. 4 is a schematic depicting at least one of a plurality of suction ports offset from a reference suction port by an angle in a clockwise direction equal to $\{[(360°/N)\cdot([N-1]-n)]+X°\}$, according to an embodiment of the present invention.

Referring to FIG. 4, suction ports 900 according to an embodiment of the present invention are depicted. Although suction ports 900 in this embodiment are described in connection with a seven-cylinder compressor, it will be understood by those of ordinary skill in the art that suction ports 900 of this embodiment may be employed in any multi-cylinder compressor, and that the number of suction ports 900 corresponds to the number cylinder bores 16*a*. In this embodiment, compressor 100 may comprise cylinder bores $\mathbf{16}a_1$–$\mathbf{16}a_7$ centered on an arc having a radius (R), and suction ports 900*a*–900*g* having center portions 950*a*–950*g*, respectively. Specifically, suction port 900*a* may be positioned adjacent to suction port 900*b*, suction port 900*b* may be positioned adjacent to suction port 900*c*, suction port 900*c* may be positioned adjacent to suction port 900*d*, suction port 900*d* may be positioned adjacent to suction port 900*e*, suction port 900*e* may be positioned adjacent to suction port 900*f*, suction port 900*f* may be positioned adjacent to suction port 900*g*, and suction port 900*g* may be positioned adjacent to suction port 900*a*. Moreover, an angle $\theta_x$ in a predetermined direction, e.g., a clockwise direction, may be formed between center portion 950*a* of suction port 900*a* and center portions 950*b*–950*g* of suction ports 900*b*–900*g*, respectively. For example, in a seven cylinder compressor, $\theta_x$ may be an angle $\theta_1$, an angle $\theta_2$, an angle $\theta_3$, an angle $\theta_4$, an angle $\theta_5$, or an angle $\theta_6$. In particular, angle $\theta_1$ may be associated with suction port 900*b*, i.e., may be formed between center portion 950*a* of suction port 900*a* and center portion 950*b* of suction port 900*b*, angle $\theta_2$ may be associated with suction port 900*c*, i.e., may be formed between center portion 950*a* and center portion 950*c* of suction port 900*c*, and angle $\theta_3$ may be associated with suction port 900*d*, i.e., may be formed between center portion 950*a* and center portion 950*d* of suction port 900*d*. Similarly, angle $\theta_4$ may be associated with suction port 900*e*, i.e., may be formed between center portion 950*a* and center portion 950*e* of suction port 900*e*, angle $\theta_5$ may be associated with suction port 900*f*, i.e., may be formed between center portion 950*a* and center portion 950*f* of suction port 900*f*, and angle $\theta_6$ may be associated with suction port 900*g*, i.e., may be formed between center portion 950*a* and center portion 950*g* of suction port 900*g*.

Figure 1:
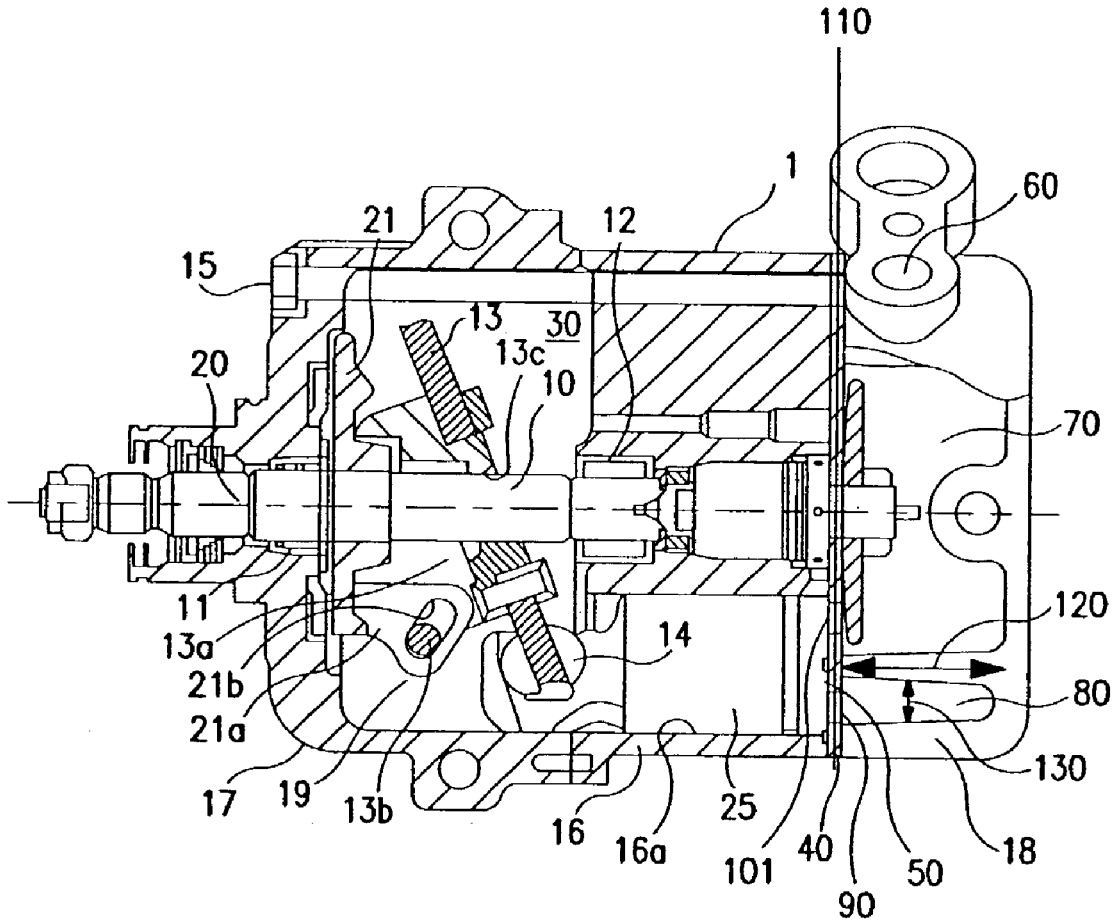
FIG. 1 PRIOR ART
FIG. 1 is a cross-sectional view of a known, swash plate-type, multi-cylinder compressor.
Figure 2:
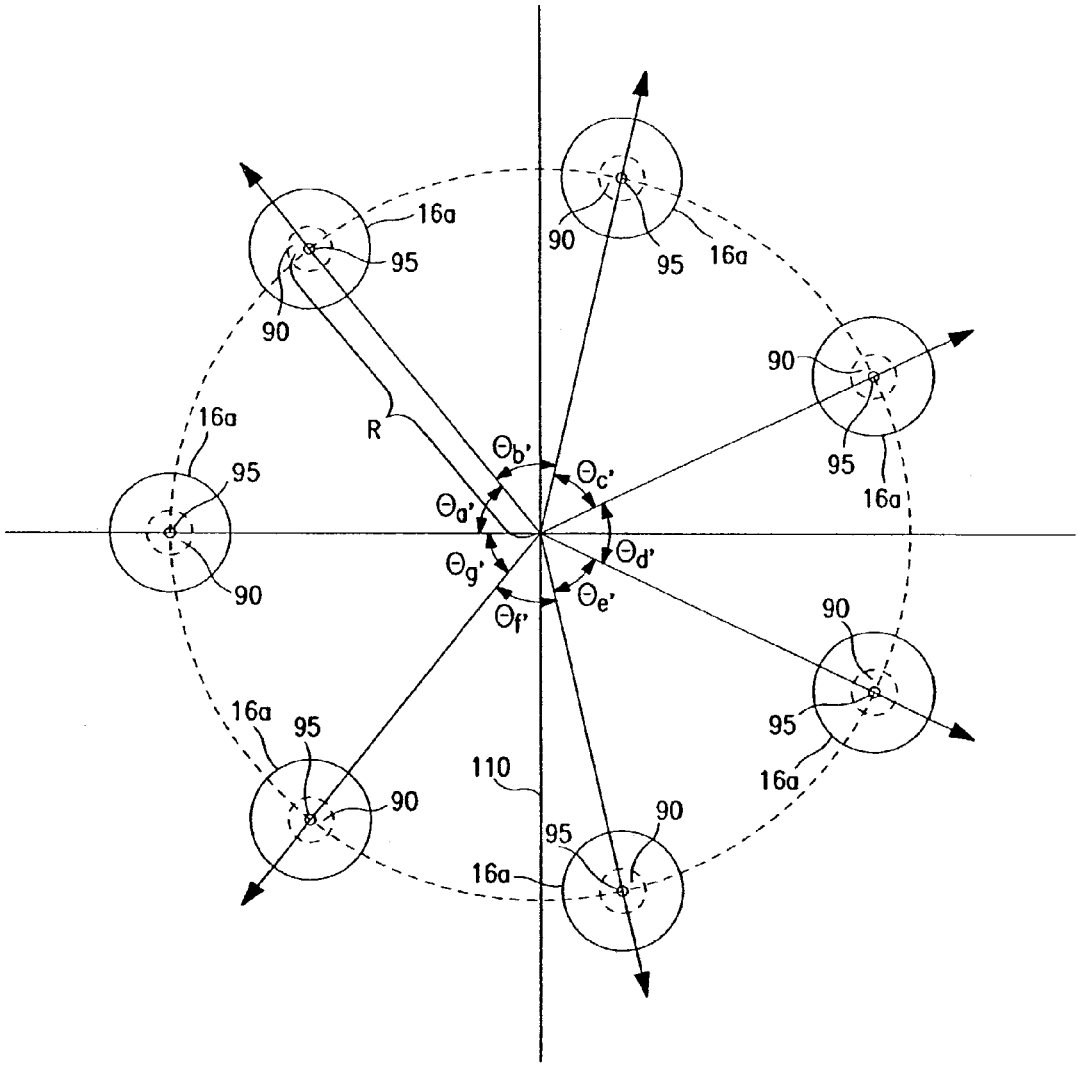
FIG. 2 is a schematic depicting a seven equiangularly spaced cylinder bores and seven equiangularly spaced suction ports of a known, swash plate-type, multi-cylinder compressor.

In an embodiment, angle $\theta_x$ may equal $\{[(360°/N)\cdot([N-1]-n)]+X_x°\}$, in which N is a number of suction ports 900 formed through valve plate 40, e.g., seven suction ports 900, n is a number of suction ports 900 positioned between a particular suction port 900*a*–900*g* which is associated with angle $\theta_x$ and suction port 900*a* in a direction opposite to the predetermined direction, e.g., a counterclockwise direction, and $X_x°$ is a predetermined angle, e.g., a predetermined angle $X_1°$–$X_6°$. For example, $\theta_1$ may equal $\{[(360°/N)\cdot([N-1]-n)]+X_1°\}$, $\theta_2$ may equal $\{[(360°/N)\cdot([N-1]-n)]+X_2°\}$, $\theta_3$ may equal $\{[(360°/N)\cdot([N-1]-n)]+X_3°\}$, $\theta_4$ may equal $\{[(360°/N)\cdot([N-1]-n)]+X_4°\}$, $\theta_5$ may equal $\{[(360°/N)\cdot([N-1]-n)]+X_5°\}$, and $\theta_6$ may equal $\{[(360°/N)\cdot([N-1]-n)]+X_6°\}$. If each of predetermined angles $X_1°$–$X_6°=0°$, center portions 950*a*–950*g* may be equiangularly centered on radius (R), e.g., as shown in FIG. 2. Specifically, if each of predetermined angles $X_1°$–$X_6°=0°$, center portions 950*a*–950*g* may be aligned with a center (not numbered) of cylinder bores 16*a*$_1$–16*a*$_7$. Nevertheless, in this embodiment of the present invention, at least one of center portions 950*b*–950*g* of suction ports 900*b*–900*g* are offset from the center of cylinder bores 16*a*$_1$–16*a*$_7$, respectively, such that at least one of predetermined angles $X_1°$–$X_6°$ does not equal 0°. Consequently, angle $\theta_x$ between suction port suction port 900*a* and at least one of suction ports 900*b*–900*g* equals $\{[(360°/N)\cdot([N-1]-n)]+X_x°\}$, in which predetermined angle $X_x°$ does not equal 0°. For example, predetermined angle $X_x°$ may be about 10°, about −10°, or any other angle which positions suction port 900 within diameter (D) of cylinder bore 16*a* and reduces a noise of compressor 100 relative to when each of predetermined angles $X_1°$–$X_6°=0°$. In an exemplary embodiment of the present invention, $X_1°$ may be about −10°, $X_2°$ may be about 10°, $X_3°$ may be about 10°, $X_4°$ may be about −10°, $X_5°$ may be about −10°, and $X_6°$ may be about 10°.

Referring to FIG. 5, the exemplary ranges for predetermined angle $X_x°$ are schematically depicted. When predetermined angle $X_x°$ is greater than 0°, predetermined angle $X_x$ may not be greater than $\sin^{-1}[(D-d)/(2\cdot R)]$ Radians, which may be converted to degrees by multiplying $X_x$ Radians by the conversion factor (630°/11)=about 57.3°/Radian. Specifically, as described above, when predetermined angle $X_x°$ is 0°, center portion 950 of the particular suction port 900*a*–900*g* which is associated with angle $\theta_x$ is aligned with the center of cylinder bore 16*a*. Moreover, when predetermined angle $X_x°$ is greater than 0°, center portion 950 of the particular suction port 900*a*–900*g* which is associated with angle $\theta_x$ is offset from the center of cylinder bore 16*a*. Nevertheless, in order for the particular suction port 900*a*–900*g* which is associated with angle $\theta_x$ to remain within diameter (D) of cylinder bore 16*a*, center portion 950 of the particular suction port 900*a*–900*g* which is associated with angle $\theta_x$ may be offset from the center of cylinder bore 16*a* by a distance less than or equal to (D−d)/2. Based on the formula Sin $X_x$=opposite/hypotenuse, it may be calculated that Sin $X_x=(D-d)/(2\cdot R)$. Consequently, the maximum value for predetermined angle $X_x°$ is $\{\sin^{-1}[(D-d)/(2\cdot R)]\cdot 57.3°/\text{Radian}\}$. Similarly, when predetermined angle $X_x°$ is less than 0°, predetermined angle $X_x$ may not be less than $-\{(\sin^{-1}[(D-d)/(2\cdot R)]\cdot 57.3°/\text{Radian}\}$ For example, if the predetermined direction is clockwise, and the particular suction port 900*a*–900*g* which is associated with angle $\theta_x$ is suction port 900*d*, i.e., when $\theta_x$ is $\theta_3$, then $\theta_3$ in the clockwise direction equals $\{[(360°/7)\cdot([7-1]-3)]+X_{3°}\}=\{[3\cdot(360°/7)]+X_3°\}$. Specifically, suctions ports 900*e*, 900*f*, and 900*g* are positioned between suction port 900*d* and suction port 900*a* in a direction opposite to the predetermined direction, i.e., in the counterclockwise direction. Similarly, if the predetermined direction is counterclockwise, and the particular suction port 900*a*–900*g* which is associated with angle $\theta_x$ is suction port 900*d*, i.e., when $\theta_x$ is $\theta_3$, then $\theta_3$ in the counterclockwise direction equals $\{[(360°/7)\cdot([7-1]-2)]+X_3°\}=\{[4\cdot(360°/7)]+X_3°\}$. Specifically, suctions ports 900*b* and 900*c* are positioned between suction port 900*d* and suction port 900*a* in a direction opposite to the predetermined direction, i.e., in the clockwise direction.

Figure 6:
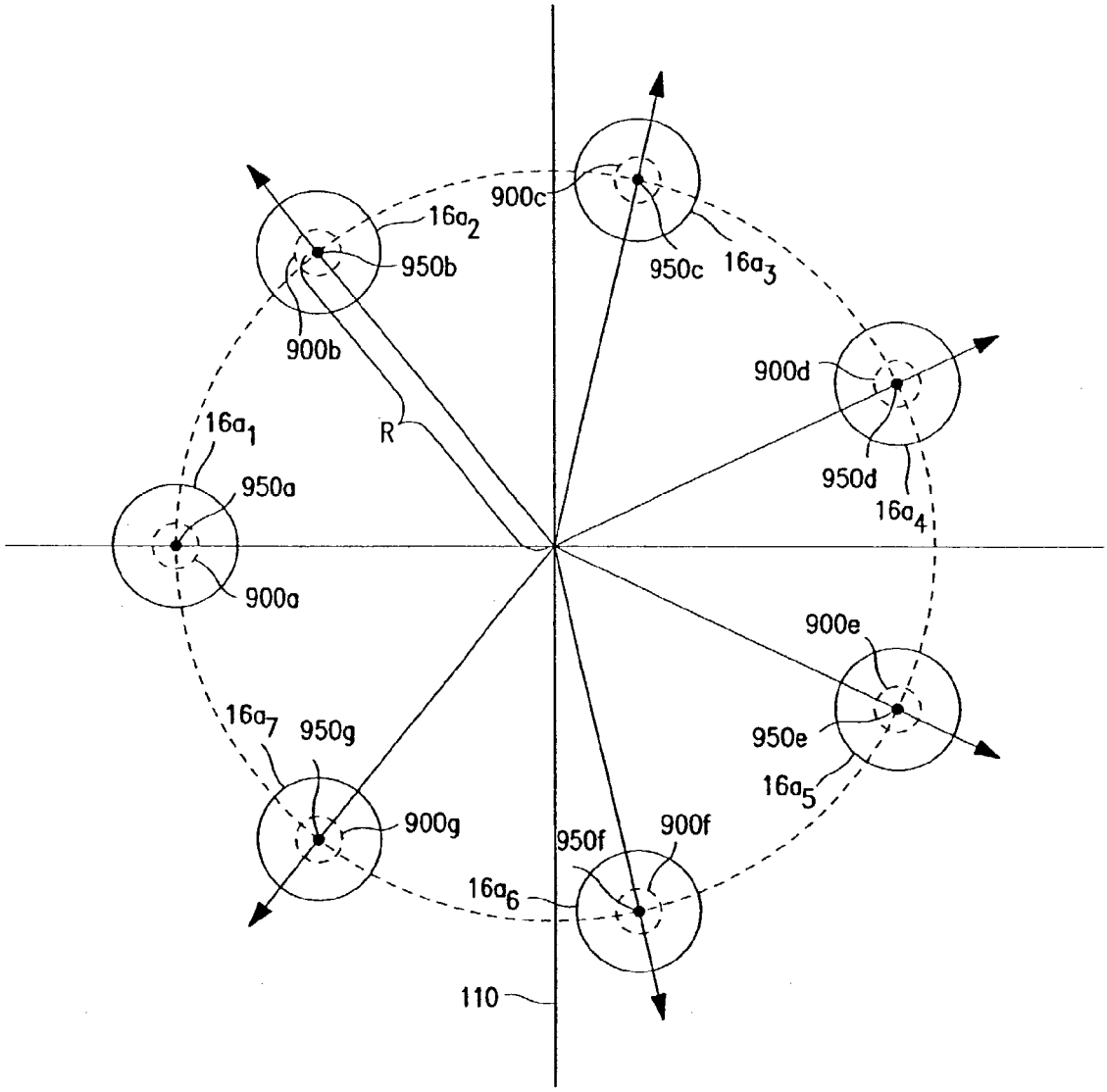
FIG. 6 is a schematic depicting a plurality of adjacent suction ports separated by angles $\theta_a$–$\theta_g$, in which at least one of $\theta_a$–$\theta_g$ is greater than or less than another of $\theta_a$–$\theta_g$.

Referring to FIG. 6, suction ports 900 according to another embodiment of the present invention are depicted. Although suction ports 900 in this embodiment are described in connection with a seven-cylinder compressor, it will be understood by those of ordinary skill in the art that suction ports 900 of this embodiment may be employed in any multi-cylinder compressor, and that the number of suction ports 900 corresponds to the number cylinder bores 16*a*. In this embodiment, an angle θ may be formed between center portions 950 of adjacent suction ports 900. For example, in a seven cylinder compressor, θ may be an angle $\theta_a$, an angle $\theta_b$, an angle $\theta_c$, an angle $\Theta_d$, an angle $\Theta_e$, an angle $\theta_f$, or an angle $\theta_g$. In particular, angle $\theta_a$ may be formed between center portion 950*a* of suction port 900*a* and center portion 950*b* of suction port 900*b*, angle $\theta_b$ may be formed between center portion 950*b* and center portion 950*c* of suction port 900*c*, and angle $\theta_c$ may be formed between center portion 950*c* and center portion 950*d* of suction port 900*d*. Similarly, angle $\theta_d$ may be formed between center portion 950*d* and center portion 950*e* of suction port 900*e*, angle $\theta_e$ may be formed between center portion 950*e* and center portion 950*f* of suction port 900*f*, angle $\theta_f$ may be formed between center portion 950*f* and center portion 950*g* of suction port 900*g*, and angle $\theta_g$ may be formed between center portion 950*g* and center portion 950*a* of suction port 900*a*.

In this embodiment, a first of suction ports 900 may be positioned adjacent to a second of suction ports 900, and the second of suction ports 900 may be positioned adjacent to a third of suction ports 900. Moreover, the angle formed between the first of suction ports 900 and the second of suction ports 900 may be different than, i.e., greater than or less than, the angle formed between the second of suction ports 900 and the third of suction ports 900. For example, angle $\theta_a$ may be greater than or less than angle $\theta_b$, or angle $\theta_b$ may be greater than or less than angle $\theta_c$, or angle $\theta_c$ may be greater than or less than angle $\theta_d$, or angle $\theta_d$ may be greater than or less than angle $\theta_e$, or angle $\theta_e$ may be greater than or less than angle $\theta_f$, or angle $\theta_f$ may be greater than or less than angle $\theta_g$, or angle $\theta_g$ may be greater than or less than angle $\theta_a$, and combinations thereof. In an embodiment, the angle formed between the first suction port 900, e.g., suction port 900*c*, and the second suction port 900, e.g., suction port 900*d*, may be between about 10° and about 30° greater than the angle formed between the second suction port 900 and the third suction port 900, e.g., suction port 900*e*. In another embodiment, the angle formed between the first suction port 900 and the second suction port 900 may be between about 10° and about 30° less than the angle formed between the second of suction ports 900 and the third of suction ports 900. Nevertheless, it will be understood by those of ordinary skill in the art that a maximum difference between the angle formed between the first suction port 900 and the second suction port 900, and the angle formed between the second suction port 900 and the third suction port 900 depends on a position of cylinder bores 16*a*, the diameter (D) of cylinder bores 16*a*, the diameter (d) of suction ports 900, and the number of cylinder bores 16*a*. Specifically, the difference between the angle formed between the first suction port 900 and the second suction port 900, and the angle formed between the second suction port 900 and the third suction port 900, may not position suction ports 900 outside their corresponding cylinder bore 16*a*.

Figure 8:
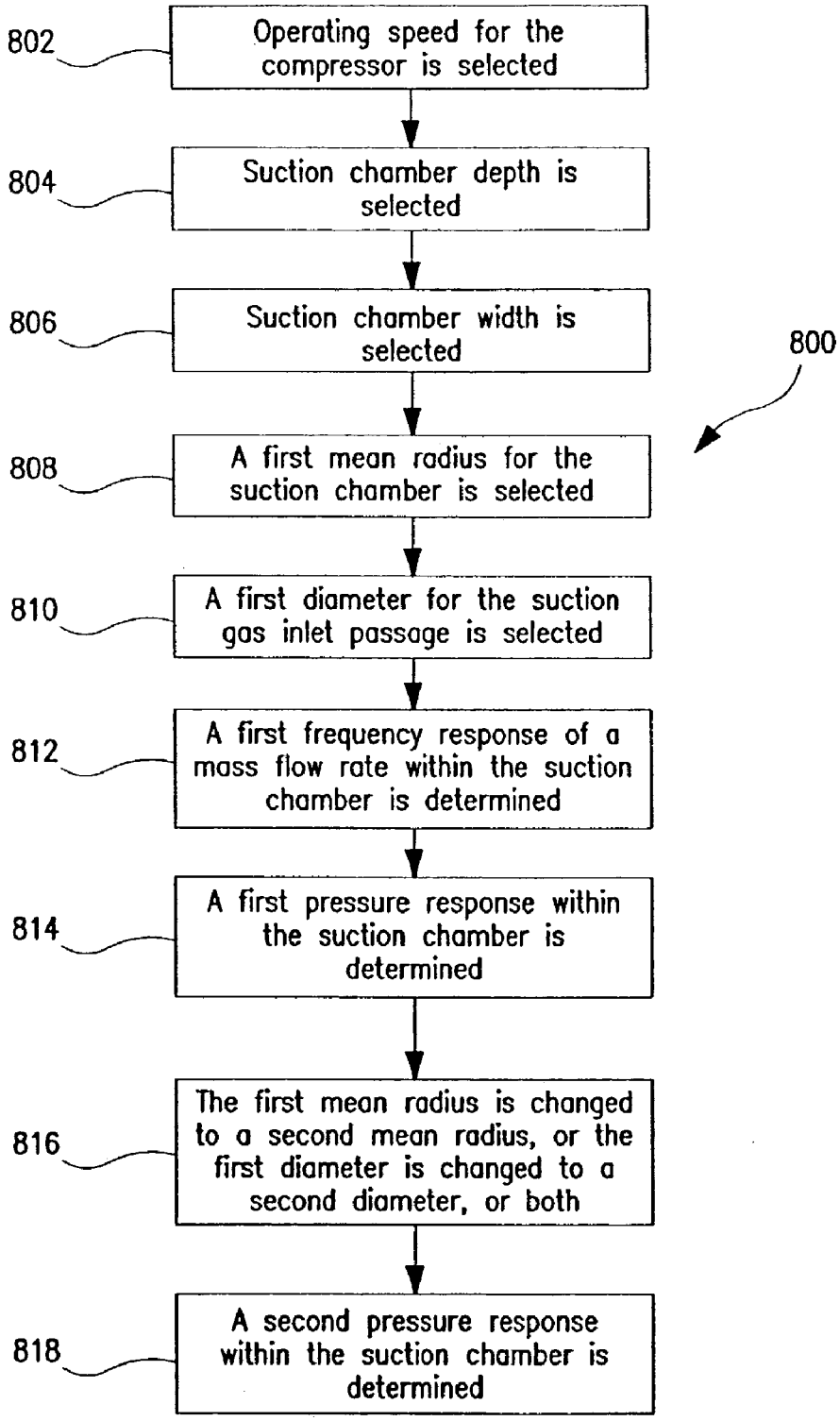
FIG. 8 is a flow chart of a method of designing a multi-cylinder compressor according to an embodiment of the present invention.
Figure 10:
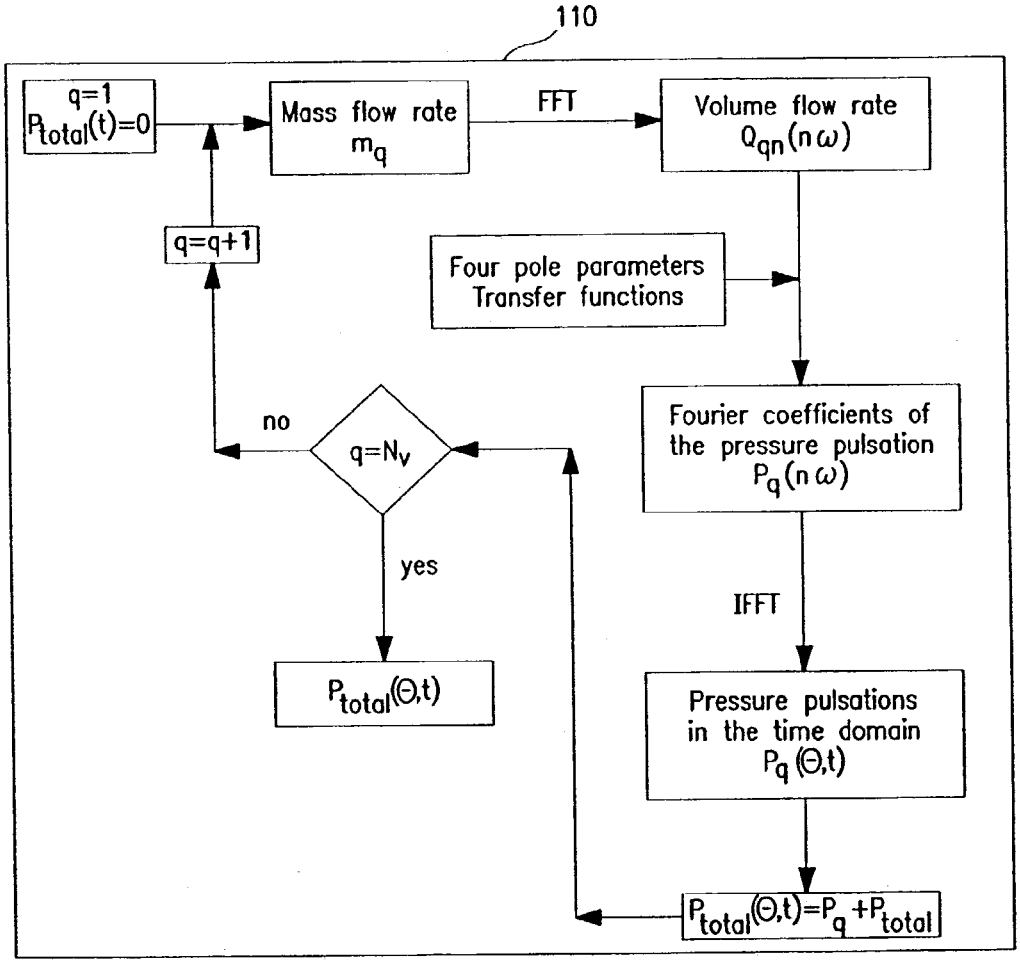
FIG. 10 is a flow chart of a simulation method for determining a frequency response of a mass flow rate in a suction chamber, according to an embodiment of the present invention.

Referring to FIG. 8, a method 800 of designing a compressor 100 according to any of the above-described embodiments of the present invention is depicted. In step 802, an operating speed for compressor 100 is selected. For example, the selected operating speed may be between about 1,000 revolutions per minute and about 2,000 revolutions per minute. In step 804, a depth of suction chamber 80 is selected. For example, the selected depth may be about 28 mm. In step 806, a width of suction chamber 80 may be selected. For example, the selected width may be about 12 mm. In step 808, a first mean radius of suction chamber 80 may be selected. For example the first mean radius of suction chamber 80 may be selected to be between about 46 mm and about 55 mm. In particular, the first mean radius of suction chamber 80 may be selected to be about 50 mm. In step 810, a first diameter of suction gas inlet passage 60 is selected. For example, the first diameter of suction gas inlet passage may be selected to be between about 6 mm and about 14 mm. In particular, the first diameter of suction gas inlet passage 60 may be selected to be about 12 mm.

Figure 11:
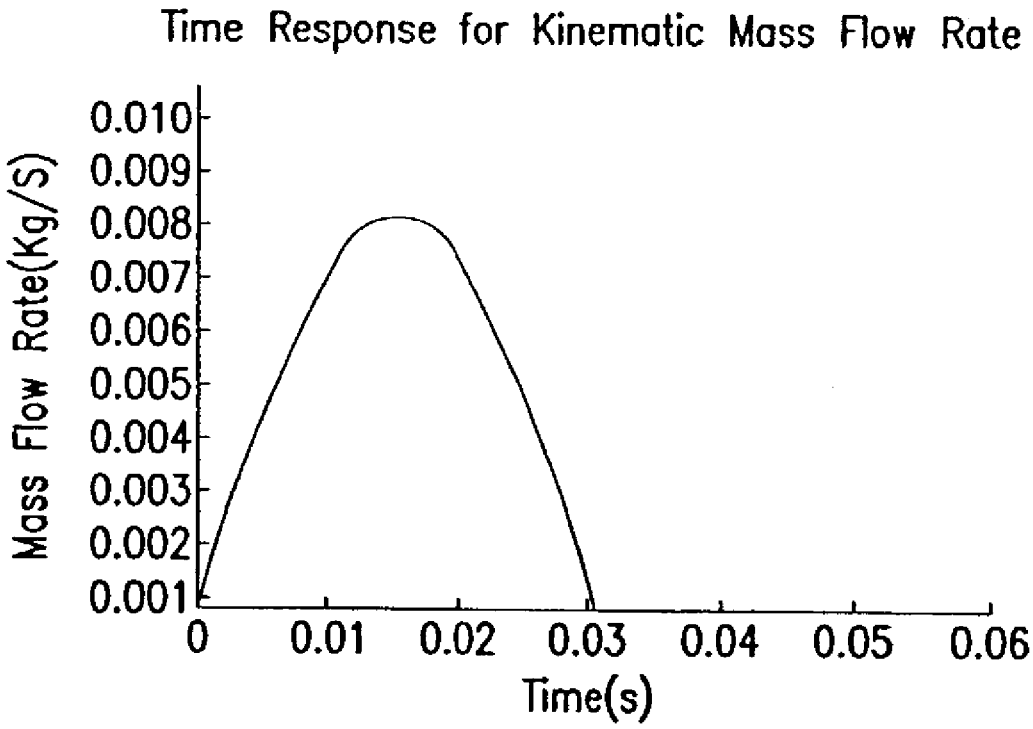
FIG. 11 is a schematic of a theoretical kinematic mass flow rate within a suction chamber, according to an embodiment of the present invention.

In step 812, a first frequency response of a mass flow rate within suction chamber 80 is determined. The first frequency response of the mass flow rate within suction chamber 80 may depend on the operating speed of compressor 100, the depth of suction chamber 80, the width of suction chamber 80, the first mean radius of suction chamber 80, the first diameter of suction gas inlet passage 60, and the number of suction ports 900. Referring to FIGS. 10–12*b*, in an embodiment, the first frequency response of the mass flow rate within suction chamber 80 may be determined using a simulation method 110. For example, FIG. 11 depicts a kinematic mass flow rate in suction chamber 80 associated with one of suction ports 900, which may be expressed analytically or as data. Simulation method 110 may perform a Fourier Transform, e.g., a Fast Fourier Transform, on the mass flow rate associated with one of suction ports 900 to obtain a volume flow rate in suction chamber 80 expressed in the time domain. The volume flow rate in the time domain subsequently may be transformed back into the frequency domain using a Discrete Fourier Transform. Moreover, a Fourier series representation of pressure pulsations in suction chamber 80 may be calculated using a known four pole parameter approach in which pressure and volume flow rate at suction gas inlet passage 60 and suction port 900 are used as variables, respectively. Subsequently, the pressure pulsation in the frequency domain may be transformed into the time domain using an Inverse Fourier Transform, e.g., an Inverse Fast Fourier Transform, and simulation 110 may continue until the pressure pulsations associated with each suction port 900 have been determined and summed using a superposition technique to produce a first resultant simulated pressure pulsation response. It will be understood by those of ordinary skill in the art that the kinematic mass flow rate for each suction port 900 is the same, except that the mass flow rate experiences a phase shift depending on a location of the particular suction port 900 relative to suction gas inlet passage 60.

Figure 12A:
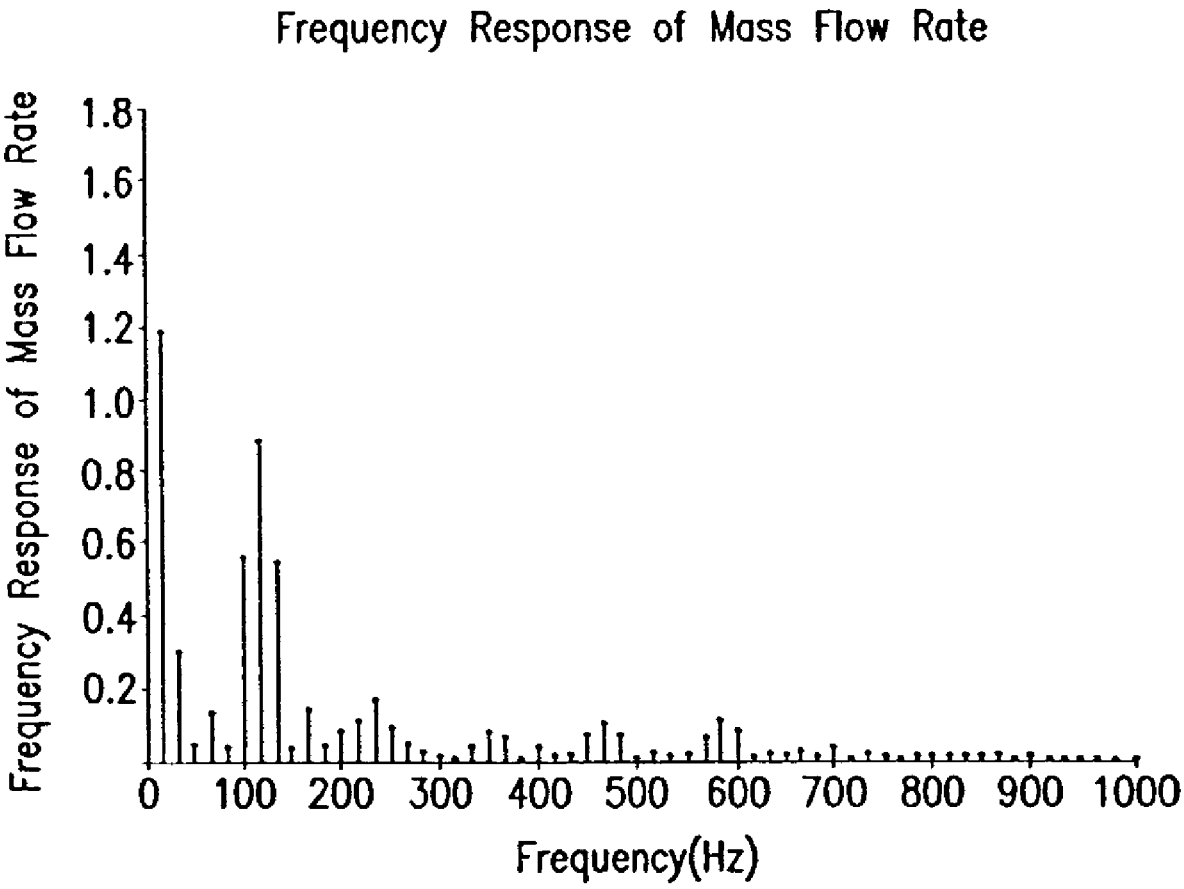
FIG. 12*a* is a graph of a frequency response of a mass flow rate in a suction chamber.
Figure 12B:
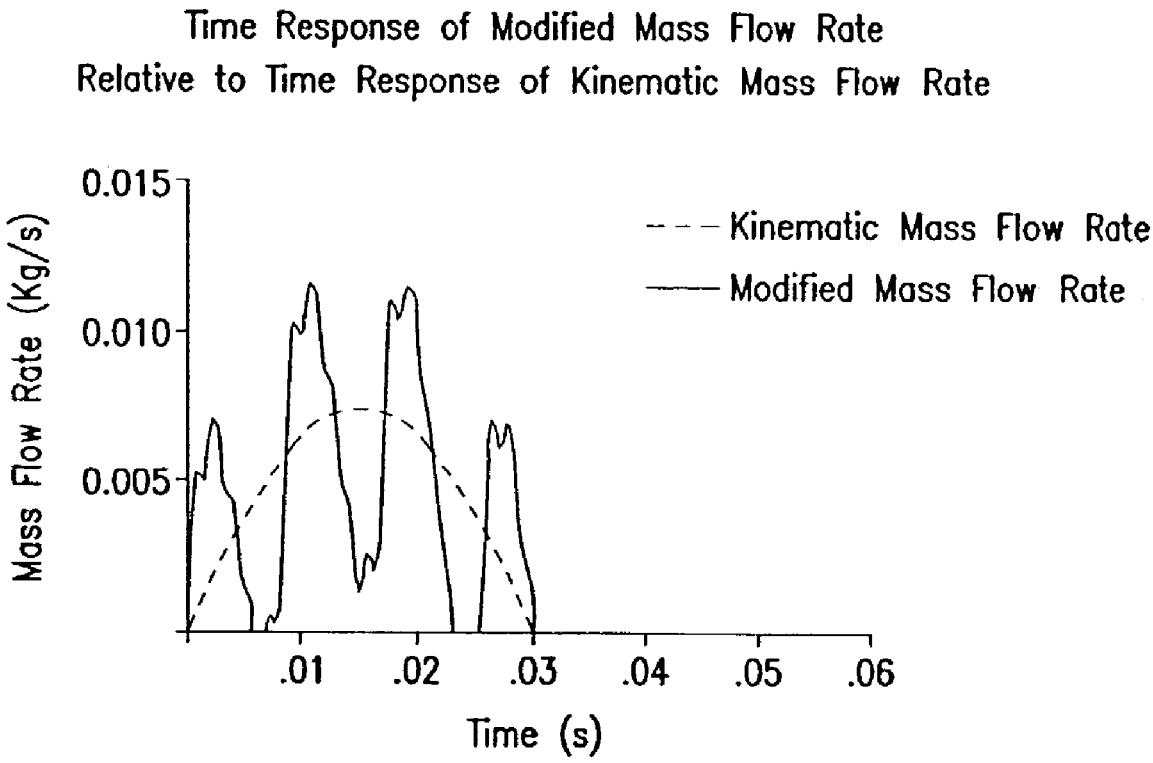
FIG. 12*b* is a graph of a time response of the mass flow rate in the suction chamber, according to an embodiment of the present invention.

Further, the first resultant simulated pressure pulsation response in suction chamber 80 may be compared to an experimentally obtained pressure pulsation response, and the kinematic mass flow rate associated with each suction port 900 may be adjusted iteratively in order to match the first resultant simulated pressure pulsation amplitudes with the experimentally obtained pressure pulsation amplitudes to obtain a first modified mass flow rate. Simulation method 110 may continue, e.g., the first modified flow rate may be adjusted to a second modified flow rate based on a comparison between a second resultant simulated pressure pulsation response and the experimentally obtained pressure pulsation response, until a particular resultant simulated pressure pulsation response amplitudes match the experimentally obtained pressure pulsation response amplitudes. When the particular resultant simulated pressure pulsation response amplitudes match the experimentally obtained pressure pulsation response amplitudes, an actual modified mass flow rate is determined. For example, the first modified mass flow rate at a particular frequency within a frequency spectrum may be equal to the kinematic mass flow rate plus an oscillation component, in which the oscillation component equals a scaler component $\acute{\alpha}$ times an error between the resultant simulated pressure pulsation response and the experimentally obtained pressure pulsation response at the particular frequency. The first modified mass flow rate may be determined at each frequency within the frequency spectrum. Moreover, the scaler component $\acute{\alpha}$ and the error may be different at each frequency. Specifically, the error may be positive or negative depending on whether the resultant simulated pressure pulsation response is greater than or less than the experimentally obtained pressure pulsation response at that particular frequency. Similarly, the second modified mass flow rate at the particular frequency within the frequency spectrum may be equal to the first modified mass flow rate plus the oscillation component. Referring to FIG. 12*b*, when a predetermined number of iterations have been completed, such that the particular resultant simulated pressure pulsation response amplitudes match the experimentally obtained pressure pulsation response amplitudes, i.e., when the error at each frequency within the frequency spectrum equals zero, the frequency response of the actual mass flow rate within suction chamber 80 is determined.

In step 814, a first dynamic pressure response within suction chamber 80 is determined. For example, the first dynamic pressure response within suction chamber 80 may depend on the actual modified mass flow rate. Specifically, after the actual modified mass flow rate is determined, simulation method 110 may be employed using the actual modified mass flow rate to determine first dynamic pressure response. Simulation method 110 operates substantially the same as described-above respect to determining the actual modified mass flow rate, except that the mass flow rate used in simulation 110 is not adjusted, and simulation 110 continues until the pressure pulsations associated with each suction port 900 have been determined and summed using a superposition technique to produce the first dynamic pressure pulsation response. In another embodiment of the present invention, method 800 further may comprise steps 816 and 818. In step 816, the first mean radius of suction chamber 80 is changed to a second mean radius, or the first diameter of suction gas inlet passage 60 is changed to a second diameter, or both. In step 818, a second dynamic pressure response within suction chamber 80 may be determined. Because the first mean radius of suction chamber 80 is different than the second mean radius of suction chamber 80, or because the first diameter of suction gas inlet passage 60 is different than the second diameter of suction gas inlet passage 60, or both, the second dynamic pressure response may be different than the first dynamic pressure response.

The above-described method may be repeated for a predetermined number of mean radiuses for suction chamber 80, e.g., five different mean radiuses for suction chamber 80, and for a predetermined number of diameters for suction gas inlet passage 60, e.g., five different diameters for suction gas inlet passage 60. Moreover, a dynamic pressure response within suction chamber 80 may be determined for each combination of suction chamber 80 mean radius and suction gas inlet passage 60 diameter, and compressor 100 may be designed based on the various dynamic pressure responses. For example, the mean radius of suction chamber 80 and the diameter of suction gas inlet passage 60 may be selected so as to minimize the dynamic pressure response within suction chamber 80 within the predetermined range of frequencies, e.g., between about 400 Hz and about 600 Hz.

While not willing to be bound by a theory, it is believed that the dynamic pressure response for a single suction port 900 may be expressed by the following formula:

$$p(\theta, t) = \sum_{n=-\infty}^{\infty} \sum_{k=1}^{\infty} \frac{jn\omega\rho c^2 Q_{2n}(n\omega)\left[\frac{1}{T_{Q_n}(n\omega)}\cos k(\theta-\theta_1) - \cos k(\theta-\theta_2)\right]}{rAN_k[(\omega_k^2-(n\omega)^2)+2j(n\omega)\omega_k\xi_k]} e^{jn\omega t}$$

in which r is the mean radius of suction chamber 80, A is the cross-sectional area of suction chamber 80, i.e., A=depth 120·width 130, c is the speed of sound in a gas, ρ is the density of fluid within suction chamber 80, Q(nω) is the mass flow rate of fluid within suction chamber 80 transformed into the frequency domain as a volume flow rate, $T_{Qn}(\omega)$ is a transfer function between a flow rate at suction gas inlet passage 60 and suction port 900, i.e., $T_{Qn}(\omega)=Q_{2n}/Q_{1n}$, in which $Q_{2n}$ is the volume flow rate at suction port 900 and $Q_{1n}$ is the volume flow rate at suction gas inlet passage 60, N is a number of suction ports 900, $\zeta_k$ is a modal damping ratio for each mode$_k$, $\theta_1$ is an angle of a center of suction gas inlet passage 60, and $\theta_2$ is an angle of center portion 950 of suction port 900. When any of depth 120, width 130, and the mean radius of suction chamber 80 increase, the denominator of the above-described formula increases. Nevertheless, based on the formula $T_{Qn}(\omega)=Q_{2n}/Q_{1n}$, $Q_{2n}(n\omega)/T_{Qn}(n\omega)=Q_{1n}$, i.e., the volume flow rate at suction gas inlet passage 60. Consequently, increasing the diameter of suction gas inlet passage 60 also may increase the numerator of the above-described formula. Further, for some increases in the diameter of suction gas inlet passage 60, the increase in the numerator may be greater than the increase in the denominator. Moreover, changes in $\theta_2$ for any one of suction ports 900 also may affect the numerator in the above-described formula, which may cause pressure pulsations to increase or decrease depending on the change in $\theta_2$.

EXAMPLES

Embodiments of the present invention will be further clarified by consideration of the following examples, which are intended to be purely exemplary of the invention.

Referring to FIG. 7, various theoretical pulsation ratios (N2/N1) for exemplary embodiments of a compressor were calculated. Specifically, center portions 950*a*–950*g* of suction ports 900*a*–900*g* initially were aligned with the center of cylinder bores 16*a*$_2$–16*a*$_7$, respectively, and a first theoretical pulsation level (N1) was calculated. Subsequently, each of center portions 950*a*–950*g* sequentially were offset 10° clockwise from their initial position, and then were offset 10° counterclockwise from their initial position. Moreover, a second theoretical pulsation level (N2) was calculated for each of these combinations of suction port 900 locations. As shown in FIG. 7, when suction port 900*b* was offset 10° counterclockwise from its initial position, and the remaining suction ports 900 were not offset from their initial positions, N2 was less than N1. Similar results were calculated when only suction port 900*c* was offset 10° clockwise, when only suction port 900*d* was offset 10° clockwise, when only suction port 900*e* was offset 10° counterclockwise, when only suction port 900*f* was offset 10° counterclockwise, and when only suction port 900*g* was offset 10° clockwise from their initial positions, respectively.

Referring again to FIG. 7, adjacent pairs of center portions 950*a*–950*g* then were sequentially offset 10° clockwise from their initial position, and then were offset 10° counterclockwise from their initial position. Moreover, N2 was calculated from each of these combinations of suction port 900 locations. As shown in FIG. 7, when suction ports 900*a* and 900*b* were offset 10° counterclockwise from their initial positions, and the remaining suction ports 900 were not offset from their initial position, N2 was less than N1. Similarly, when only suction ports 900*b* and 900*c* were offset 10° counterclockwise from their initial positions, and when only suction ports 900*e* and 900*f* were offset 10° counterclockwise from their initial positions, N2 was less than N1. Further, when only suction ports 900*c* and 900*d* were offset 10° clockwise from their initial positions, and when only suction ports 900*f* and 900*g* were offset 10° clockwise from their initial positions, N2 was less than N1.

Moreover, as shown in FIG. 7, when suction port 900*b* was offset 10° counterclockwise and suction port 900*g* was offset 10° clockwise, N2 was less than N1. Similarly, when suction port 900*b* was offset 10° counterclockwise, suction port 900*g* was offset 10° clockwise, suction port 900*d* was offset 10° clockwise, and suction port 900*e* was offset 10° counterclockwise, N2 was less than N1. Further, when suction port 900*b* was offset 10° counterclockwise, suction port 900*g* was offset 10° clockwise, suction port 900*d* was offset 10° clockwise, suction port 900*e* was offset 10° counterclockwise, suction port 900*c* was offset 10° clockwise, and suction port 900*f* was offset 10° counterclockwise, N2 was less than N1 by more than 12%.

Referring to FIG. 9, various theoretical root mean square ("RMS") average pressure pulsation ratios for exemplary embodiments of a compressor were calculated. Specifically, the constant depth of suction chamber 80 was selected to be 28 mm, the constant width of suction chamber was selected to be 12 mm, and the constant operating speed of compressor 100 was selected to be 1,000 revolutions per minute. Moreover, an initial mean radius of suction chamber 80 was selected to be 50 mm, and an initial diameter of suction gas inlet passage 60 was selected to be 12 mm. The theoretical RMS average pressure pulsation within suction chamber 80 when the mean radius was 50 mm and the diameter was 12 mm then was calculated, i.e., the normalized RMS average pressure pulsation. The theoretical RMS average pressure pulsation within suction chamber 80 then was calculated for all combinations of the mean radius of suction chamber 80 equal to 46 mm, 48 mm, 50 mm, 52 mm, and 54 mm, and the diameter of suction gas inlet passage 60 equal to 6 mm, 8 mm, 10 mm, 12 mm, and 14 mm. The theoretical RMS average pressure pulsation within suction chamber 80 when the mean radius was 50 mm and the diameter was 12 mm then was divided by the theoretical RMS average pressure pulsation for each of these combinations in order to obtain a theoretical RMS average pressure pulsation ratio for each of these combinations. As shown in FIG. 9, the minimum theoretical RMS average pressure pulsation ratio was obtained when the mean radius of suction chamber 80 was 48 mm, and the diameter of suction gas inlet passage 60 was 14 mm.

While the invention has been described in connecting with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. It is intended that the specification and the described examples are considered as exemplary only, with the true scope and spirit of the invention indicated by the following claims.

What is claimed is:

1. A multi-cylinder compressor, comprising:

a valve plate comprising a plurality of cylinder suction ports formed therethrough;

a plurality of cylinder bores centered on an arc having a radius (R), wherein the cylinder bores are substantially equally spaced from each other, and have a diameter (D); and a suction chamber having a substantially annular shape and adapted to be in fluid communication with each of the cylinder bores via the suction ports, wherein a center of a first suction port is radially offset in a predetermined direction from a center of a predetermined suction port by a first angle, wherein the predetermined suction port has a diameter (d), and the first angle equals $\{[(360°/N)\cdot([N-1]-n)]+X°\}$, in which N is a number of the suction ports formed through the valve plate, n is a number of the suction ports positioned between the first suction port and the predetermined suction port in a direction opposite to the predetermined direction, and X° is a predetermined angle which is less than or equal to $\{(\sin^{-1}[(D-d)/(2\cdot R)])\cdot 57.3°/\text{Radian}\}$ and greater than or equal to $-\{(\sin^{-1}[(D-d)/(2\cdot R)])\cdot 57.3°/\text{Radian}\}$, and which is not equal to 0°.

2. The compressor of claim 1, further comprising a discharge chamber, wherein the valve plate further comprises a plurality of cylinder discharge ports formed therethrough, and the discharge chamber is adapted to be in fluid communication with each of the cylinder bores via the discharge ports, wherein the suction chamber extends around the discharge chamber.

3. The compressor of claim 1, wherein the predetermined direction is clockwise.

4. The compressor of claim 3, wherein the predetermined angle X° is a positive angle.

5. The compressor of claim 3, wherein the predetermined angle X° is a negative angle.

6. The compressor of claim 1, wherein the predetermined direction is counterclockwise.

7. The compressor of claim 6, wherein the predetermined angle X° is a positive angle.

8. The compressor of claim 6, wherein the predetermined angle X° is a negative angle.

9. The compressor of claim 1, wherein the predetermined direction is clockwise, and the predetermined suction port is positioned adjacent to the first suction port, wherein the predetermined angle X° is a negative angle.

10. The compressor claim 1, wherein a second of the suction ports is positioned adjacent to the first suction port, and a third of the suction ports is positioned adjacent to the second suction port, wherein the predetermined direction is clockwise, the predetermined suction port is the third suction port, and the predetermined angle X° is a positive angle.

11. The compressor claim 1, wherein a second of the suction ports is positioned adjacent to the first suction port, a third of the suction ports is positioned adjacent to the second suction port, and a fourth of the suction ports is positioned adjacent to the third suction port, wherein the predetermined direction is clockwise, the predetermined suction port is the fourth suction port, and the predetermined angle X° is a positive angle.

12. The compressor claim 1, wherein a second of the suction ports is positioned adjacent to the first suction port, a third of the suction ports is positioned adjacent to the second suction port, a fourth of the suction ports is positioned adjacent to the third suction port, and a fifth of the suction ports is positioned adjacent to fourth suction port, wherein the predetermined direction is clockwise, the predetermined suction port is the fifth suction port, and the predetermined angle X° is a negative angle.

13. The compressor claim 1, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, and a sixth of the suction ports is positioned adjacent to the fifth suction port, wherein the predetermined direction is clockwise, the predetermined suction port is the sixth suction port, and the predetermined angle X° is a negative angle.

14. The compressor of any of claims 5, 8, 9, 12, and 13, wherein the predetermined angle X° is about −10°.

15. The compressor claim 1, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, a sixth of the suction ports is positioned adjacent to the fifth suction port, and a seventh of the suction ports is positioned adjacent to the sixth suction port, wherein the predetermined direction is clockwise, the predetermined suction port is the seventh suction port, and the predetermined angle X° is a positive angle.

16. The compressor of any of claims 4, 7, 10, 11, and 15, wherein the predetermined angle X° is about 10°.

17. The compressor of claim 1, wherein the first suction port is radially offset from a first predetermined suction port by the first angle, and the first suction port is radially offset from a second predetermined suction port by a second angle, wherein the first predetermined suction port has a first diameter ($d_1$), and the second predetermined suction port has a second diameter ($d_2$), wherein the first angle equals $\{[(360°/N)\cdot([N-1]-n)]+X_1°\}$ and the second angle equals $\{[(360°/N)\cdot([N-1]-n)]+X_2°\}$, in which $X_1°$ is a first predetermined angle which is less than or equal to $\{(\sin^{-1}[(D-d_1)/(2\cdot R)])\cdot 57.3°/\text{Radian}\}$ and greater than or equal to $-\{(\sin^{-1}[(D-d_1)/(2\cdot R)])\cdot 57.3°/\text{Radian}\}$, and which is not equal to 0°, and $X_2°$ is a second predetermined angle which is less than or equal to $\{(\sin^{-1}[(D-d_2)/(2\cdot R)])\cdot 57.3°/\text{Radian}\}$ and greater than or equal to $-\{(\sin^{-1}[(D-d_2)/(2\cdot R)])\cdot 57.3°/\text{Radian}\}$, and which is not equal to 0°.

18. The compressor of claim 17, wherein a second of the suction ports is positioned adjacent to the first suction port, and a third of the suction ports is positioned adjacent to the second suction port, wherein the predetermined direction is clockwise, the first predetermined suction port is the second suction port, the second predetermined suction port is the third suction port, the first predetermined angle $X_1°$ is a negative angle, and the second predetermined angle $X_2°$ is a negative angle.

19. The compressor claim 18, wherein a second of the suction ports is positioned adjacent to the first suction port, a third of the suction ports is positioned adjacent to the second suction port, and a fourth of the suction ports is positioned adjacent to the third suction port, wherein the predetermined direction is clockwise, the first predetermined suction port is the third suction port, the second predetermined suction port is the fourth suction port, the first predetermined angle $X_1°$ is a positive angle, and the second predetermined angle $X_2°$ is a positive angle.

20. The compressor claim 18, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, and a sixth of the suction ports is positioned adjacent to the fifth suction port, wherein the predetermined direction is clockwise, the first predetermined suction port is the fifth suction port, the second predetermined suction port is the sixth suction port, the first predetermined angle $X_1°$ is a negative angle, and the second predetermined angle $X_2°$ is a negative angle.

21. The compressor of any of claims 18 and 20, wherein the first predetermined angle $X_1°$ is about −10° and the second predetermined angle $X_2°$ is about −10°.

22. The compressor claim 18, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, a sixth of the suction ports is positioned adjacent to the fifth suction port, and a seventh of the suction ports is positioned adjacent to the sixth suction port, wherein the predetermined direction is clockwise, the first predetermined suction port is the sixth suction port, the second predetermined suction port is the seventh suction port, the first predetermined angle $X_1°$ is a positive angle, and the second predetermined angle $X_2°$ is a positive angle.

23. The compressor of any of claims 19 and 22, wherein the first predetermined angle $X_1°$ is about 10° and the second predetermined angle $X_2°$ is about 10°.

24. The compressor claim 18, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, a sixth of the suction ports is positioned adjacent to the fifth suction port, and a seventh of the suction ports is positioned adjacent to the sixth suction port, wherein the predetermined direction is clockwise, the first predetermined suction port is the second suction port, the second predetermined suction port is the seventh suction port, the first predetermined angle $X_1°$ is a negative angle, and the second predetermined angle $X_2°$ is a positive angle.

25. The compressor of claim 24, wherein the first predetermined angle $X_1°$ is about −10° and the second predetermined angle $X_2°$ is about 10°.

26. The compressor of claim 18, wherein the first suction port is radially offset from a third predetermined suction port by a third angle, and the first suction port is radially offset from a fourth predetermined suction port by a fourth angle, wherein the third predetermined suction port has a third diameter ($d_3$), and the fourth predetermined suction port has a fourth diameter ($d_4$), wherein the third angle equals $\{[(360°/N)\cdot([N-1]-n)]+X_3°\}$ and the fourth angle equals $\{[(360°/N)\cdot([N-1]-n)]+X_4°\}$, in which $X_3°$ is a third predetermined angle which is less than or equal to $\{(\sin^{-1}[(D-d_3)/(2\cdot R)])\cdot 57.3°/\text{Radian}\}$ and greater than or equal to $-\{(\sin^{-1}[(D-d_3)/(2\cdot R)])\cdot 57.3°/\text{Radian}\}$, and which is not equal to 0°, and $X_4°$ is a fourth predetermined angle which is less than or equal to $\{(\sin^{-1}[(D-d_4)/(2\cdot R)])\cdot 57.3°/\text{Radian}\}$ and greater than or equal to $-\{(\sin^{-1}[(D-d_4)/(2\cdot R)])\cdot 57.3°/\text{Radian}\}$, and which is not equal to 0°.

27. The compressor of claim 26, wherein a second of the suction ports is positioned adjacent to the first suction port, a third of the suction ports is positioned adjacent to the second suction port, a fourth of the suction ports is positioned adjacent to the third suction port, a fifth of the suction ports is positioned adjacent to fourth suction port, a sixth of the suction ports is positioned adjacent to the fifth suction port, and a seventh of the suction ports is positioned adjacent to the sixth suction port, wherein the predetermined direction is clockwise, the first predetermined suction port is the second suction port, the second predetermined suction port is the fourth suction port, the third predetermined suction port is the fifth suction port, and the fourth predetermined suction port is the seventh suction port, wherein the first predetermined angle $X_1°$ is a negative angle, the second predetermined angle $X_2°$ is a positive angle, the third predetermined angle $X_3°$ is a negative angle, and the fourth predetermined angle $X_4°$ is a positive angle.

28. The compressor of claim 27, wherein the first predetermined angle $X_1°$ is about −10°, the second predetermined angle $X_2°$ is about 10°, the third predetermined angle $X_3°$ is about −10°, and the fourth predetermined angle $X_4°$ is about 10°.

29. The compressor of claim 27, wherein the first suction port is radially offset from a fifth predetermined suction port by a fifth angle, and the first suction port is radially offset from a sixth predetermined suction port by a sixth angle, wherein the fifth predetermined suction port has a fifth diameter ($d_5$), and the sixth predetermined suction port has a sixth diameter ($d_6$), wherein the fifth angle equals $\{[(360°/N)\cdot([N-1]-n)]+X_5°\}$ and the sixth angle equals $\{[(360°/N)\cdot([N-1]-n)]+X_6°\}$, in which $X_5°$ is a fifth predetermined angle which is less than or equal to $\{(\sin^{-1}[(D-d_5)/(2\cdot R)])\cdot 57.3°/\text{Radian}\}$ and greater than or equal to $-\{(\sin^{-1}[(D-d_5)/(2\cdot R)])\cdot 57.3°/\text{Radian}\}$, and which is not equal to 0°, and $X_6°$ is a second predetermined angle which is less than or equal to $\{(\sin^{-1}[(D-d_2)/(2\cdot R)])\cdot 57.3°/\text{Radian}\}$ and greater than or equal to $-\{(\sin^{-1}[(D-d_2)/(2\cdot R)])\cdot 57.3°/\text{Radian}$, and which is not equal to 0°.

30. The compressor of claim 29, wherein the fifth predetermined suction port is the third suction port, the sixth predetermined suction port is the sixth suction port, the fifth predetermined angle $X_5°$ is a positive angle, and the sixth predetermined angle $X_6°$ is a negative angle.

31. The compressor of claim 30, wherein the first predetermined angle $X_1°$ is about −10°, the second predetermined angle $X_2°$ is about 10°, the third predetermined angle $X_3°$ is about −10°, the fourth predetermined angle $X_4°$ is about 10°, the fifth predetermined angle $X_5°$ is about 10°, and the sixth predetermined angle $X_6°$ is about −10°.

32. The compressor of claim 1, wherein at least one of the suction ports has a diameter between about 6 mm and about 14 mm.

33. The compressor of claim 32, wherein the suction chamber has a varying radius, and a mean radius of the suction chamber is between about 46 mm and about 54 mm.

34. A suction manifold joining a plurality of cylinders in a suction chamber, comprising:

a plurality of cylinder bores centered on an arc having a radius (R), wherein the cylinder bores are substantially equally spaced from each other, and have a diameter (D); and a valve plate comprising a plurality of cylinder suction ports formed therethrough, wherein a center of a first of the suction ports is radially offset in a predetermined direction from a center of a predetermined suction port by a first angle, wherein the predetermined suction port has a diameter (d), and the first angle equals $\{[(360°/N)\cdot([N-1]-n)]+X°\}$, in which N is a number of the suction ports formed through the valve plate, n is a number of the suction ports positioned between the first suction port and the predetermined suction port in a direction opposite to the predetermined direction, and X° is a predetermined angle which less than or equal to $\{(\sin^{-1}[(D-d)/(2\cdot R)])\cdot 57.3°/\text{Radian}\}$ and greater than or equal to $-\{(\sin^{-1}[(D-d)/(2\cdot R)])\cdot 57.3°/\text{Radian}\}$, and which is not equal to 0°.

35. The manifold of claim 34, wherein the predetermined direction is clockwise.

36. The manifold of claim 34, wherein the predetermined direction is counterclockwise.

37. The manifold of claim 35, wherein the predetermined angle X° is a positive angle.

38. The manifold of claim 37, wherein the predetermined angle X° is about 10°.

39. The manifold of claim 35, wherein the predetermined angle X° is a negative angle.

40. The manifold of claim 39, wherein the predetermined angle X° is about −10°.

41. The manifold of claim 34, wherein at least one of the suction ports has a diameter greater than about 6 mm and less than about 14 mm.

42. The manifold of claim 41, wherein at least one of the suction ports has a diameter of about 14 mm.

43. The manifold of claim 41, wherein the suction chamber has a varying radius, and a mean radius of the suction chamber is greater than about 46 mm and less than about 54 mm.

44. The manifold of claim 43, wherein the mean radius of the suction chamber is about 48 mm.

45. A multi-cylinder compressor, comprising:

a valve plate comprising a plurality of cylinder suction ports formed therethrough, wherein a first of the suction ports is positioned adjacent to a second of the suction ports, and the second suction port is positioned adjacent to a third of the suction ports;

a plurality of cylinder bores; and a suction chamber having a substantially annular shape and adapted to be in fluid communication with each of the cylinder bores via the suction ports, wherein the second suction port is radially offset from the first suction port by a first angle, and the third suction port is radially offset from the second suction port by a second angle, wherein the first angle is greater than or less than the second angle.

46. The compressor of claim 45, further comprising a discharge chamber, wherein the valve plate further comprises a plurality of cylinder discharge ports formed therethrough, and the discharge chamber is adapted to be in fluid communication with each of the cylinder bores via the discharge ports, wherein the suction chamber extends around the discharge chamber.

47. The compressor of claim 45, wherein the second angle is greater than the first angle.

48. The compressor of claim 47, wherein the second angle is between about 10° and about 30° greater than the first angle.

49. The compressor of claim 48, wherein the second angle is about 30° greater than the first angle.

50. The compressor of claim 48, wherein the second angle is about 20° greater than the first angle.

51. The compressor of claim 45, wherein the first angle is greater than the second angle.

52. The compressor of claim 51, wherein the first angle is between about 10° and about 30° greater than the second angle.

53. The compressor of claim 52, wherein the first angle is about 30° greater than the second angle.

54. The compressor of claim 52, wherein the first angle is about 20° greater than the second angle.

55. The compressor of claim 45, wherein at least one of the suction ports has a diameter greater than about 6 mm and less than about 14 mm.

56. The compressor of claim 55, wherein the suction chamber has a varying radius, and a mean radius of the suction chamber is greater than about 46 mm and less than about 54 mm.

57. A valve plate assembly, comprising:

a valve plate comprising a plurality of cylinder suction ports formed therethrough, wherein a first of the suction ports is positioned adjacent to a second of the suction ports, and the second suction port is positioned adjacent to a third of the suction ports, wherein the second suction port is radially offset from the first suction port by a first angle, and the third suction port is radially offset from the second suction port by a second angle, wherein the first angle is greater than or less than the second angle.

58. The valve plate assembly of claim 57, wherein the second angle is greater than the first angle.

59. The valve plate assembly of claim 58, wherein the second angle is between about 10° and about 30° greater than the first angle.

60. The valve plate assembly of claim 59, wherein the second angle is about 30° greater than the first angle.

61. The valve plate assembly of claim 59, wherein the second angle is about 20° greater than the first angle.

62. The valve plate assembly of claim 57, wherein the first angle is greater than the second angle.

63. The valve plate assembly of claim 62, wherein the first angle is between about 10° and about 30° greater than the second angle.

64. The valve plate assembly of claim 63, wherein the first angle is about 30° greater than the second angle.

65. The valve plate assembly of claim 63, wherein the first angle is about 20° greater than the second angle.

66. A multi-cylinder compressor, comprising:

a valve plate comprising a plurality of cylinder suction ports formed therethrough, wherein the plurality of suction ports comprise a first suction port, a second suction port, and a third suction port, and the second suction port is positioned between and adjacent to the first suction port and the third suction port, wherein a center of the first suction port is radially offset in a predetermined direction from a center of the second suction port by a first angle, and the center of the second suction port is radially offset in the predetermined direction from a center of the third suction port by a second angle which is not equal to the first angle, wherein at least one of the suction ports has a diameter greater than about 6 mm and less than about 14 mm a plurality of cylinder bores; and a suction chamber having a substantially annular shape and adapted to be in fluid communication with each of the cylinder bores via the suction ports, wherein the suction chamber has a varying radius, and a mean radius of the suction chamber is greater than about 46 mm and less than about 54 mm.

67. The compressor of claim 66, wherein the diameter of the suction port is about 6 mm and the mean radius of the suction chamber is about 48 mm.

68. The compressor of claim 66, wherein the diameter of the suction port is about 8 mm and the mean radius of the suction chamber is about 48 mm.

69. The compressor of claim 66, wherein the diameter of the suction port is about 10 mm and the mean radius of the suction chamber is about 48 mm.

70. The compressor of claim 66, wherein the diameter of the suction port is about 12 mm and the mean radius of the suction chamber is about 48 mm.

71. The compressor of claim 66, wherein the diameter of the suction port is about 14 mm and the mean radius of the suction chamber is about 48 mm.

72. The compressor of claim 66, wherein the diameter of the suction port is about 14 mm and the mean radius of the suction chamber is about 46 mm.

73. The compressor of claim 66, wherein the diameter of the suction port is about 14 mm and the mean radius of the suction chamber is about 50 mm.

74. The compressor of claim 66, wherein the diameter of the suction port is about 14 mm and the mean radius of the suction chamber is about 52 mm.

75. The compressor of claim 66, wherein the diameter of the suction port is about 14 mm and the mean radius of the suction chamber is about 54 mm.

76. The compressor of claim 66, wherein the diameter of the suction port is about 12 mm and the mean radius of the suction chamber is about 46 mm.

77. A method of designing a multi-cylinder compressor comprising a valve plate comprising a plurality of cylinder suction ports formed therethrough, a plurality of cylinder bores, a suction chamber having a substantially annular shape and adapted to be in fluid communication with each of the cylinder bores via the suction ports, wherein the suction chamber has a varying radius, and a suction gas inlet passage connected to the suction chamber, comprising the steps of:

selecting an operating speed for the compressor;

selecting a depth for the suction chamber;

selecting a width for the suction chamber;

selecting a first mean radius for the suction chamber;

selecting a first diameter for the suction gas inlet passage;

determining a frequency response of a mass flow rate of fluid within the suction chamber; and subsequently determining a first dynamic pressure response within the suction chamber using the frequency response of the mass flow rate of the fluid within the suction chamber.

78. The method of claim 77, further comprising the steps of:

changing the first mean radius to a second mean radius for the suction chamber; and determining a second dynamic pressure response within the suction chamber using the frequency response of the mass flow rate of the fluid within the suction chamber.

79. The method of claim 77, further comprising the steps of:

changing the first diameter to a second diameter for the suction gas inlet passage; and determining a second dynamic pressure response within the suction chamber using the frequency response of the mass flow rate of the fluid within the suction chamber.

80. The method of claim 79, further comprising the steps of:

changing the first mean radius to a second mean radius for the suction chamber; and determining a third dynamic pressure response within the suction chamber using the frequency response of the mass flow rate of the fluid within the suction chamber.

81. The method of claim 80, further comprising the steps of:

selecting a mean radius for the suction chamber, wherein the selected mean radius is one of the first mean radius and the second mean radius; and selecting a diameter for the suction gas inlet passage, wherein the selected diameter is one of the first diameter and the second diameter, wherein the mean radius and the diameter are selected based on the first dynamic pressure response, the second dynamic pressure response, and the third dynamic pressure response.

82. The method of claim 81, wherein the selected diameter is greater than about 6 mm and less than about 14 mm, and the selected mean radius is greater than about 46 mm and less than about 54 mm.

83. The method of claim 82, wherein the predetermined operating speed is about 1000 revolutions per minute, the predetermined width is about 12 mm, and the predetermined depth is about 28 mm.

84. The manifold of claim 36, wherein the predetermined angle X° is a positive angle.

85. The manifold of claim 84, wherein the predetermined angle X° is about 10°.

86. The manifold of claim 36, wherein the predetermined angle X° is a negative angle.

87. The manifold of claim 86, wherein the predetermined angle X° is about −10°.

* * * * *